US009908335B2

(12) United States Patent
Komplin et al.

(10) Patent No.: US 9,908,335 B2
(45) Date of Patent: Mar. 6, 2018

(54) FLUIDIC DISPENSING DEVICE HAVING FEATURES TO REDUCE STAGNATION ZONES

(71) Applicant: FUNAI ELECTRIC CO., LTD., Osaka (JP)

(72) Inventors: Steven R. Komplin, Lexington, KY (US); James D. Anderson, Jr., Harrodsburg, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 15/216,104

(22) Filed: Jul. 21, 2016

(65) Prior Publication Data

US 2018/0022099 A1 Jan. 25, 2018

(51) Int. Cl.
*B41J 2/175* (2006.01)
*B41J 2/18* (2006.01)
*B41J 2/165* (2006.01)

(52) U.S. Cl.
CPC ..... *B41J 2/175* (2013.01); *B41J 2/165* (2013.01); *B41J 2/17513* (2013.01); *B41J 2/18* (2013.01); *B41J 2/17596* (2013.01)

(58) Field of Classification Search
CPC . B41J 2/175; B41J 2/17513; B41J 2/18; B41J 2/165; B41J 2/17596
See application file for complete search history.

(56) References Cited

U.S. PATENT DOCUMENTS 5,198,156 A 3/1993 Middleton et al.
6,332,676 B1 12/2001 Santhanam
7,172,272 B2 2/2007 Tsuchiya et al.
8,608,300 B2 12/2013 Igawa et al.
2001/0013886 A1 8/2001 Underwood et al.
2001/0015742 A1 8/2001 Childers
2001/0024225 A1 9/2001 Ishizawa et al.
2001/0030675 A1 10/2001 Kobayashi et al.
2002/0012026 A1 1/2002 Kubota et al.
2002/0089576 A1 7/2002 Ishizawa et al.
2002/0109760 A1 8/2002 Miyazawa et al.
2002/0154570 A1 10/2002 Gebrian
2002/0167555 A1 11/2002 Miura et al.
2003/0042274 A1 3/2003 Johanson
2003/0072216 A1 4/2003 Araki
(Continued)

FOREIGN PATENT DOCUMENTS

EP 2919072 A1 9/2015
JP 2006235470 A 9/2006

*Primary Examiner* — Geoffrey Mruk
(74) *Attorney, Agent, or Firm* — Aust IP Law

(57) ABSTRACT

A fluidic dispensing device includes a housing, and a fluid channel in the housing. The fluid channel has a channel inlet, a channel outlet, and a passage between the channel inlet and the channel outlet. The channel inlet is in fluid communication with an inlet port of a chamber. The channel outlet is in fluid communication with an outlet port of the chamber. The passage is in fluid communication with an opening in an exterior wall. The fluid channel has a first corner structure in the passage. A stir bar is located in the chamber to generate a fluid flow through the fluid channel when rotated. A first flow director member is positioned adjacent the channel inlet. The flow director member has a first surface structure that directs a portion of the fluid flow toward the first corner structure in the passage.

20 Claims, 23 Drawing Sheets

(56) References Cited

U.S. PATENT DOCUMENTS

2003/0107950 A1 6/2003 Shepherd et al.
2004/0051766 A1 3/2004 Miyazawa et al.
2004/0095842 A1 5/2004 Weetman
2004/0104984 A1 6/2004 Hall et al.
2005/0046682 A1 3/2005 Kawamoto
2005/0093211 A1 5/2005 Shiraishi et al.
2005/0248634 A1 11/2005 Aruga
2006/0071989 A1 4/2006 Lewey et al.
2006/0268080 A1 11/2006 Nakazawa
2006/0290753 A1 12/2006 Tatsumi et al.
2007/0019047 A1 1/2007 Kleinert et al.
2007/0052771 A1 3/2007 Inoue et al.
2007/0052773 A1 3/2007 Kawamura et al.
2007/0165485 A1 7/2007 Cai
2007/0188563 A1 8/2007 Takahashi
2007/0242114 A1 10/2007 Kubota et al.
2008/0031088 A1 2/2008 Ukita
2008/0165233 A1 7/2008 Lin et al.
2008/0186368 A1 8/2008 Silverbrook et al.
2009/0033725 A1 2/2009 Toba et al.
2009/0079802 A1 3/2009 Ito
2009/0122121 A1 5/2009 Kawasaki et al.
2009/0189931 A1 7/2009 Noro et al.
2009/0213159 A1 8/2009 Aoki et al.
2009/0251517 A1 10/2009 Matsumoto
2009/0289976 A1 11/2009 Nishimura
2009/0322840 A1 12/2009 Wanibe
2010/0103233 A1 4/2010 Akatsuka et al.
2011/0280098 A1 11/2011 Shiono
2012/0000645 A1 1/2012 Willimczik
2012/0056948 A1* 3/2012 Kim ..... B41J 2/17509 347/85
2012/0062523 A1 3/2012 Park et al.
2012/0075364 A1 3/2012 Nakazawa
2012/0105555 A1 5/2012 Mcfarland et al.
2012/0140003 A1 6/2012 Szusdziara et al.
2012/0200645 A1 8/2012 Okina
2012/0200649 A1 8/2012 Igawa et al.
2013/0342618 A1 12/2013 Frasure et al.
2014/0061961 A1 3/2014 Ishizawa et al.
2014/0098146 A1 4/2014 Kamiyama
2015/0165399 A1 6/2015 Rawlings
2015/0343784 A1 12/2015 Anderson, Jr. et al.

* cited by examiner

FLUIDIC DISPENSING DEVICE HAVING FEATURES TO REDUCE STAGNATION ZONES

CROSS-REFERENCE TO RELATED APPLICATIONS

This application is related to U.S. patent application Ser. No. 15/183,666, now U.S. Pat. No. 9,744,771; Ser. No. 15/183,693, now U.S. Pat. No. 9,707,767; Ser. No. 15/183,705, now U.S. Pat. No. 9,751,315; Ser. No. 15/183,722, now U.S. Pat. No. 9,751,316; Ser. Nos. 15/183,736; 15/193,476; 15/239,113; 15/256,065, now U.S. Pat. No. 9,688,074; Ser. Nos. 15/278,369; 15/373,123; 15/373,243; 15/373,635; 15/373,684; and Ser. No. 15/435,983.

BACKGROUND OF THE INVENTION

1. Field of the Invention

The present invention relates to fluidic dispensing devices, and, more particularly, to a fluidic dispensing device, such as a microfluidic dispensing device, having features to reduce stagnation zones.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device. If settling or separation of the fluid occurs, it is almost impossible to re-mix the fluid contained in the capillary member.

Another type of printhead is referred to in the art as a free fluid style printhead, which has a movable wall that is spring loaded to maintain backpressure at the nozzles of the printhead. One type of spring loaded movable wall uses a deformable deflection bladder to create the spring and wall in a single piece. An early printhead design by Hewlett-Packard Company used a circular deformable rubber part in the form of a thimble shaped bladder positioned between a lid and a body that contained ink. The deflection of the thimble shaped bladder collapsed on itself. The thimble shaped bladder maintained backpressure by deforming the bladder material as ink was delivered to the printhead chip.

In a fluid tank where separation of fluids and particulate may occur, it is desirable to provide a mixing of the fluid. For example, particulate in pigmented fluids tend to settle depending on particle size, specific gravity differences, and fluid viscosity. U.S. Patent Application Publication No. 2006/0268080 discloses a system having an ink tank located remotely from the fluid ejection device, wherein the ink tank contains a magnetic rotor, which is rotated by an external rotary plate, to provide bulk mixing in the remote ink tank.

It has been recognized, however, that a microfluidic dispensing device having a compact design, which includes both a fluid reservoir and an on-board fluid ejection chip, presents particular challenges that a simple agitation in a remote tank does not address. For example, it has been determined that not only does fluid in the bulk region of the fluid reservoir need to be remixed, but remixing in the ejection chip region also is desirable, and in some cases, may be necessary, in order to prevent the clogging of the region near the fluid ejection chip with settled particulate.

Further, it has been recognized that even with remixing, there is a potential for stagnation zones to be created in a fluid channel of a fluidic dispensing device, wherein settled particulate is not affected by the fluid flow through the fluid channel and/or a fluid flow through the fluid channel may result in an unintentional depositing of particulate. Such stagnation zones may be created, for example, at locations in the fluid channel where there are abrupt changes in the surface features, such as in a corner defined by orthogonal planar surfaces.

What is needed in the art is a fluidic dispensing device having features to reduce stagnation zones in a fluid channel in the vicinity of the ejection chip.

SUMMARY OF THE INVENTION

The present invention provides a fluidic dispensing device having features to reduce stagnation zones in a fluid channel in the vicinity of the ejection chip.

The invention, in one form, is directed to a fluidic dispensing device including a housing having an exterior wall and a chamber. The exterior wall has a chip mounting surface and an opening. The chamber has an inlet port and an outlet port, the inlet port being separated a distance from the outlet port. An ejection chip is mounted to the chip mounting surface. The ejection chip is in fluid communication with the opening. A fluid channel in the housing has a channel inlet, a channel outlet, and a passage between the channel inlet and the channel outlet. The channel inlet is in fluid communication with the inlet port of the chamber. The channel outlet is in fluid communication with the outlet port of the chamber. The passage is in fluid communication with the opening in the exterior wall. The fluid channel has a first corner structure in the passage. A stir bar is located in the chamber to generate a fluid flow through the fluid channel when rotated. A first flow director member is positioned adjacent the channel inlet. The flow director member has a first surface structure that directs a portion of the fluid flow toward the first corner structure in the passage.

The invention, in another form, is directed to a fluidic dispensing device including a housing having an exterior wall and a chamber. The exterior wall has a chip mounting surface defining a first plane and has an opening. The chamber is configured to define an interior space. The chamber has an inlet port and an outlet port. The inlet port is separated a distance from the outlet port. An ejection chip is mounted to the chip mounting surface of the exterior wall. The ejection chip is in fluid communication with the opening. A fluid channel is formed in the housing. The fluid channel has a channel inlet, a channel outlet, and a passage between the channel inlet and the channel outlet. The opening extends between the passage and the chip mounting surface of the exterior wall. The channel inlet is in fluid communication with the inlet port of the chamber and the channel outlet being in fluid communication with the outlet port of the chamber. The passage has an outer wall structure and an inner wall structure. The outer wall structure is spaced away from the inner wall structure. The outer wall structure includes a first corner structure and a second corner structure. A stir bar, when rotated, generates a fluid flow into the channel inlet, through the passage, and out of the channel outlet. A first flow director member is positioned adjacent the channel inlet. The first flow director member has a first surface structure that directs a portion of the fluid flow toward the first corner structure in the passage. A second flow director member is positioned adjacent the channel outlet. The second flow director member has a second surface structure.

The invention, in another form, is directed to a fluidic dispensing device that includes a housing having an exterior wall and a chamber. The exterior wall has a chip mounting surface for mounting an ejection chip. The chamber defines an interior space. The chamber has a base wall, an interior perimetrical wall, an inlet port and an outlet port. The inlet port is separated a distance from the outlet port. A stir bar is located in the chamber. A fluid channel in the housing has a channel inlet, a channel outlet, and a passage between the channel inlet and the channel outlet. The channel inlet is in fluid communication with the inlet port of the chamber. The channel outlet is in fluid communication with the outlet port of the chamber. The passage is in fluid communication with the opening in the exterior wall. An inlet transition passage is oriented to extend from the inlet port of the chamber and into the channel inlet of the fluid channel. The inlet transition passage has a plurality of surfaces that converge in a direction from the chamber toward the opening in the exterior wall. An outlet transition passage is oriented to extend from the outlet port of the chamber and into the channel outlet of the fluid channel. The outlet transition passage has a plurality of surfaces that diverge in a direction away from the opening in the exterior wall and toward the chamber.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
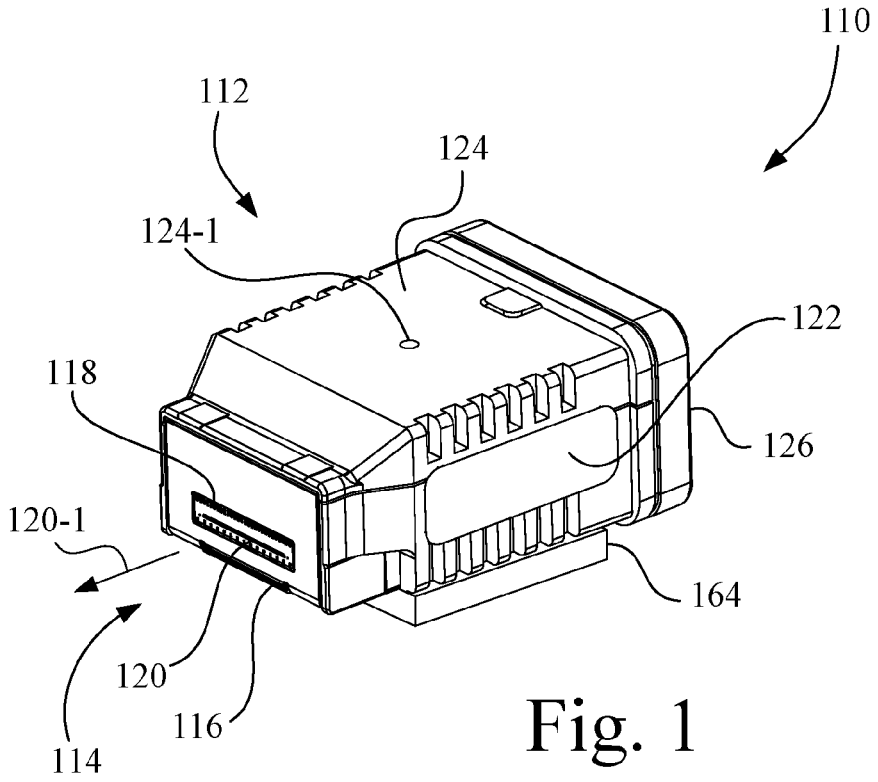
FIG. 1 is a perspective view of an embodiment of a microfluidic dispensing device in accordance with the present invention, in an environment that includes an external magnetic field generator.
Figure 2:
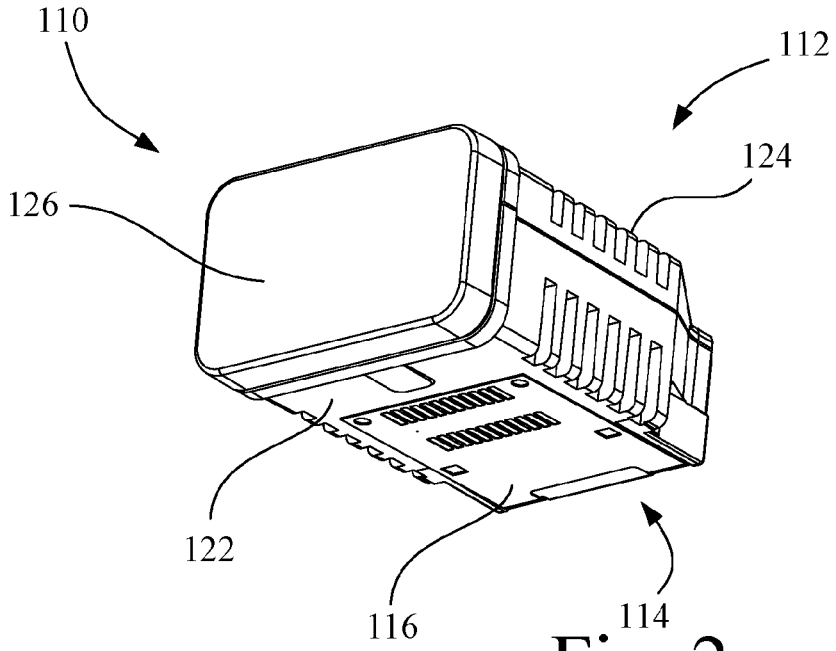
FIG. 2 is another perspective view of the microfluidic dispensing device of FIG. 1.
Figure 3:
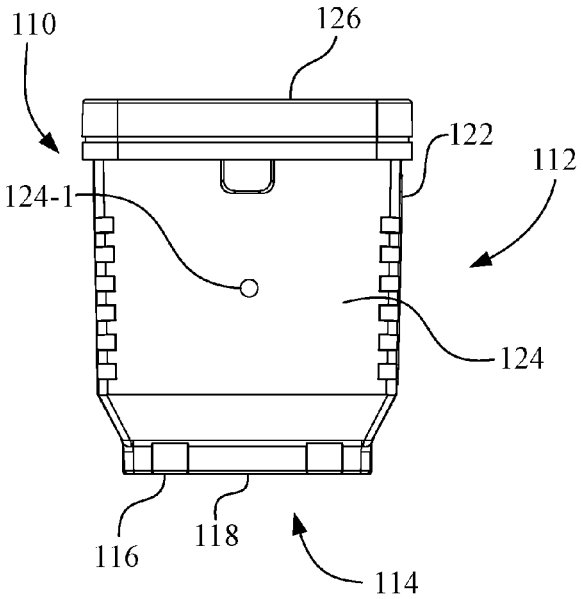
FIG. 3 is a top orthogonal view of the microfluidic dispensing device of FIGS. 1 and 2.
Figure 4:
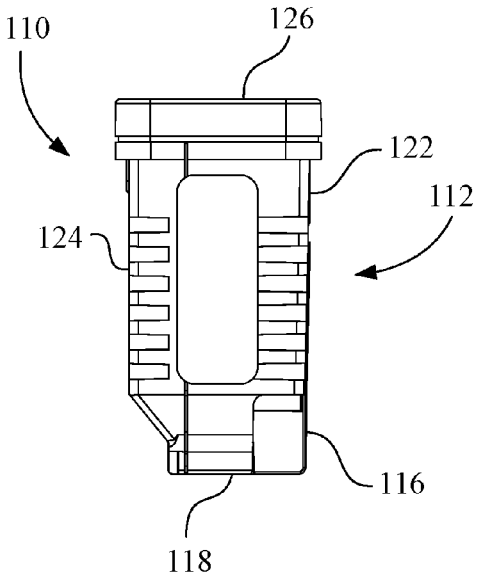
FIG. 4 is a side orthogonal view of the microfluidic dispensing device of FIGS. 1 and 2.
Figure 5:
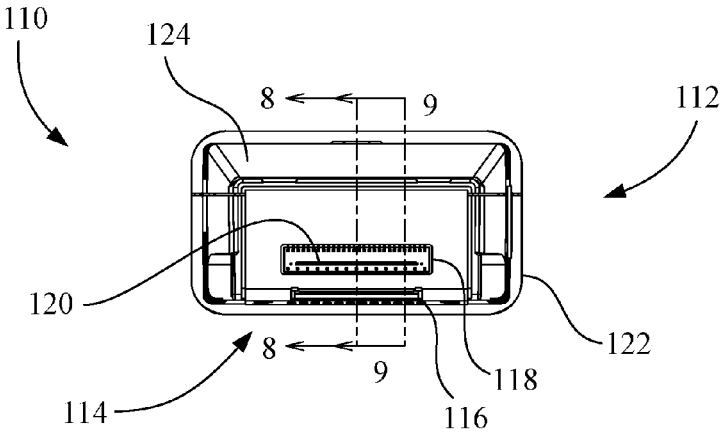
FIG. 5 is an end orthogonal view of the microfluidic dispensing device of FIGS. 1 and 2.

Referring now to the drawings, and more particularly to FIGS. 1-16, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

Figure 6:
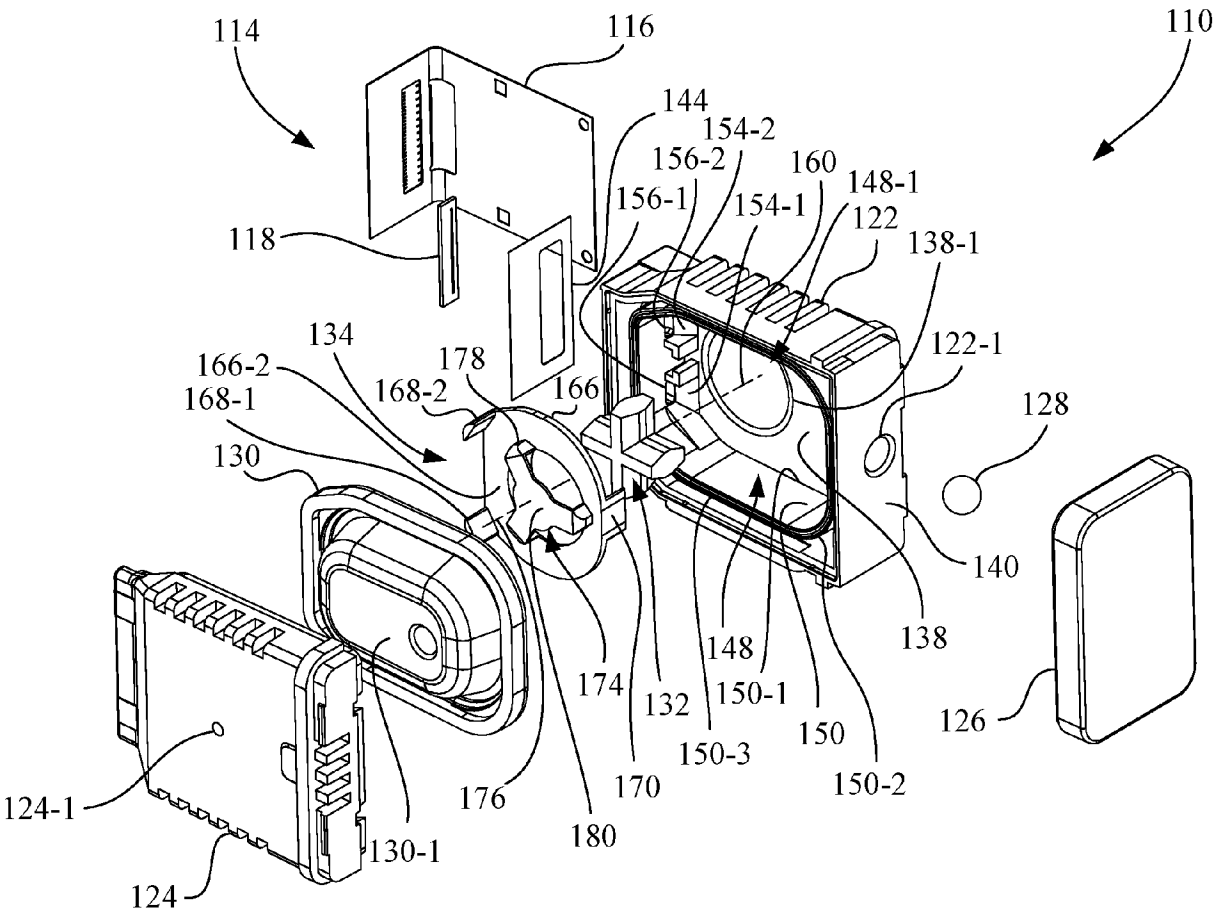
FIG. 6 is an exploded perspective view of the microfluidic dispensing device of FIGS. 1 and 2, oriented for viewing into the chamber of the body in a direction toward the ejection chip.
Figure 7:
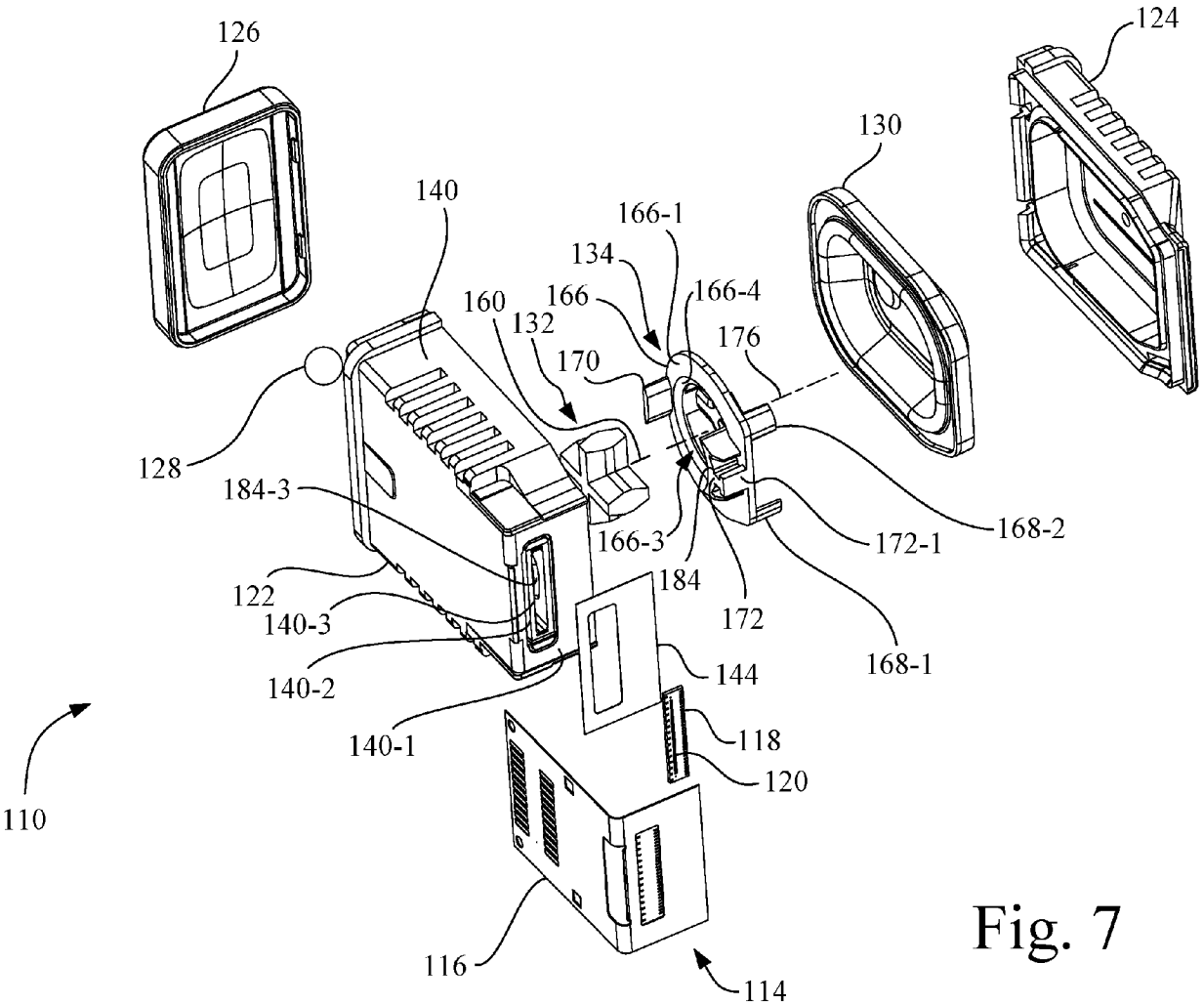
FIG. 7 is another exploded perspective view of the microfluidic dispensing device of FIGS. 1 and 2, oriented for viewing in a direction away from the ejection chip.

Referring also to FIGS. 6 and 7, TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

As best shown in FIGS. 6 and 7, housing 112 includes a body 122, a lid 124, an end cap 126, and a fill plug 128 (e.g., ball). Contained within housing 112 is a diaphragm 130, a stir bar 132, and a guide portion 134. Each of the housing 112 components, stir bar 132, and guide portion 134 may be made of plastic, using a molding process. Diaphragm 130 is made of rubber, using a molding process. Also, in the present embodiment, fill plug 128 may be in the form of a stainless steel ball bearing.

Figure 8:
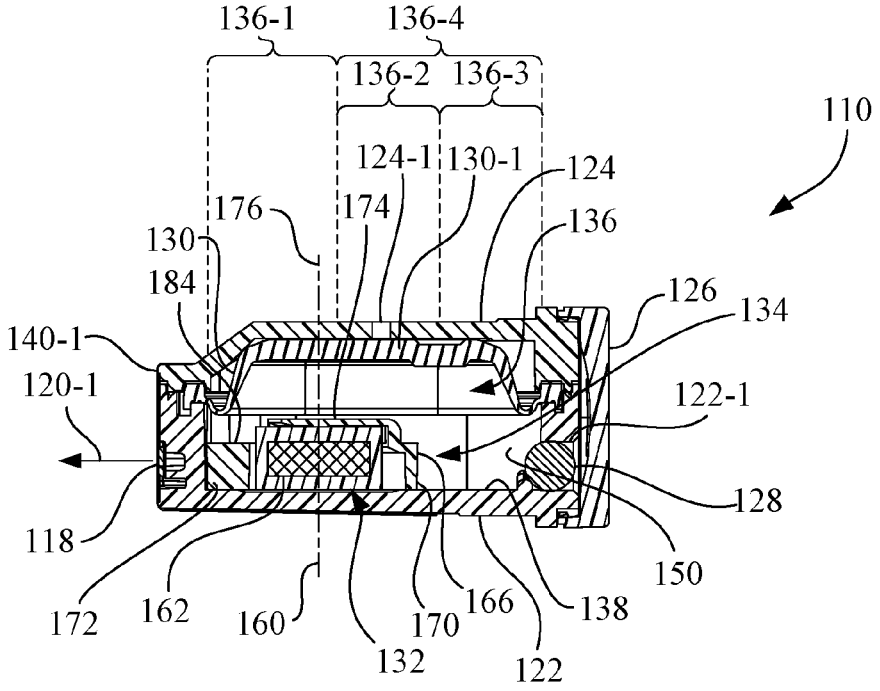
FIG. 8 is a section view of the microfluidic dispensing device of FIG. 1, taken along line 8-8 of FIG. 5.
Figure 9:
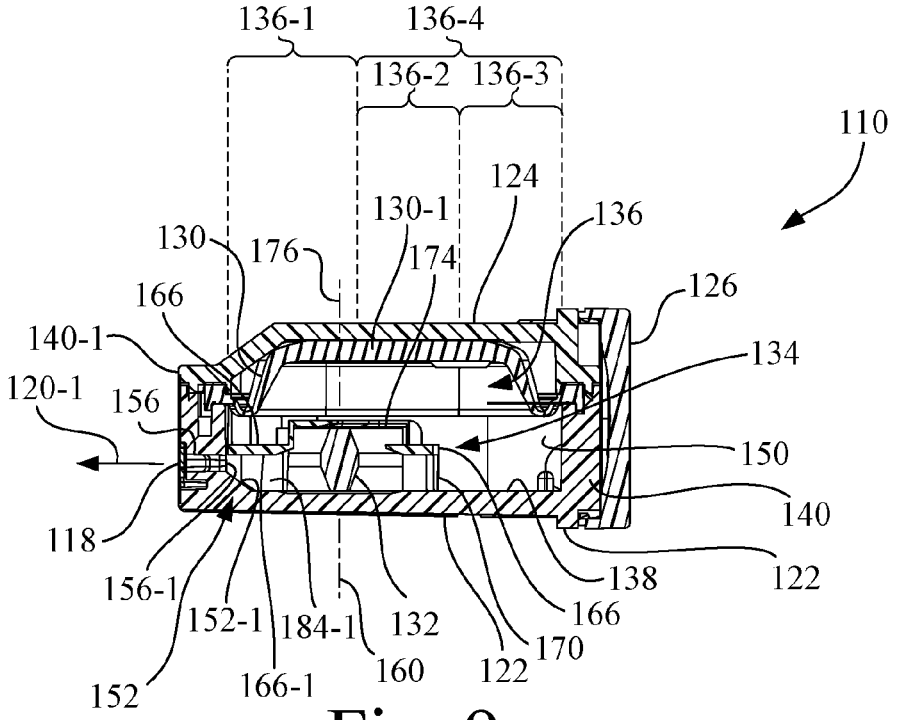
FIG. 9 is a section view of the microfluidic dispensing device of FIG. 1, taken along line 9-9 of FIG. 5.
Figure 10:
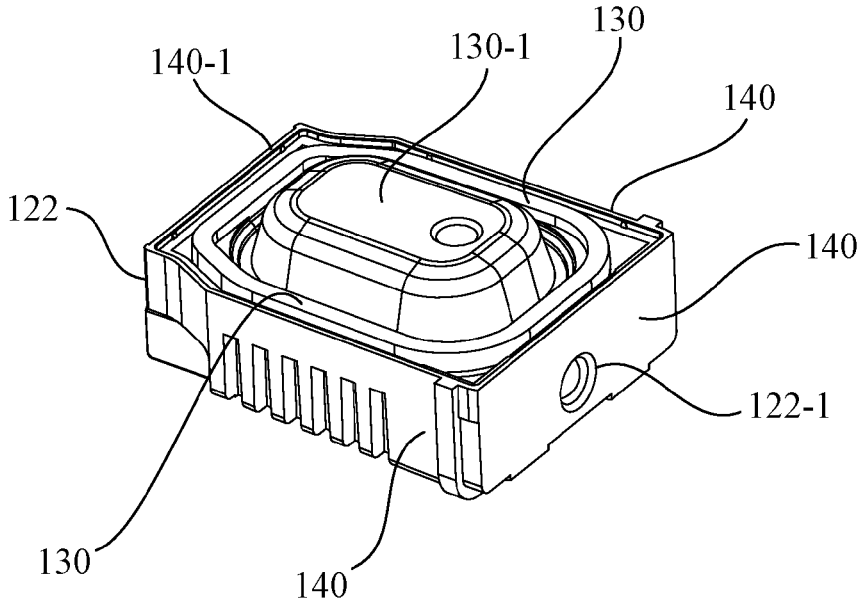
FIG. 10 is a perspective view of the microfluidic dispensing device of FIG. 1, with the end cap and lid removed to expose the body/diaphragm assembly.
Figure 11:
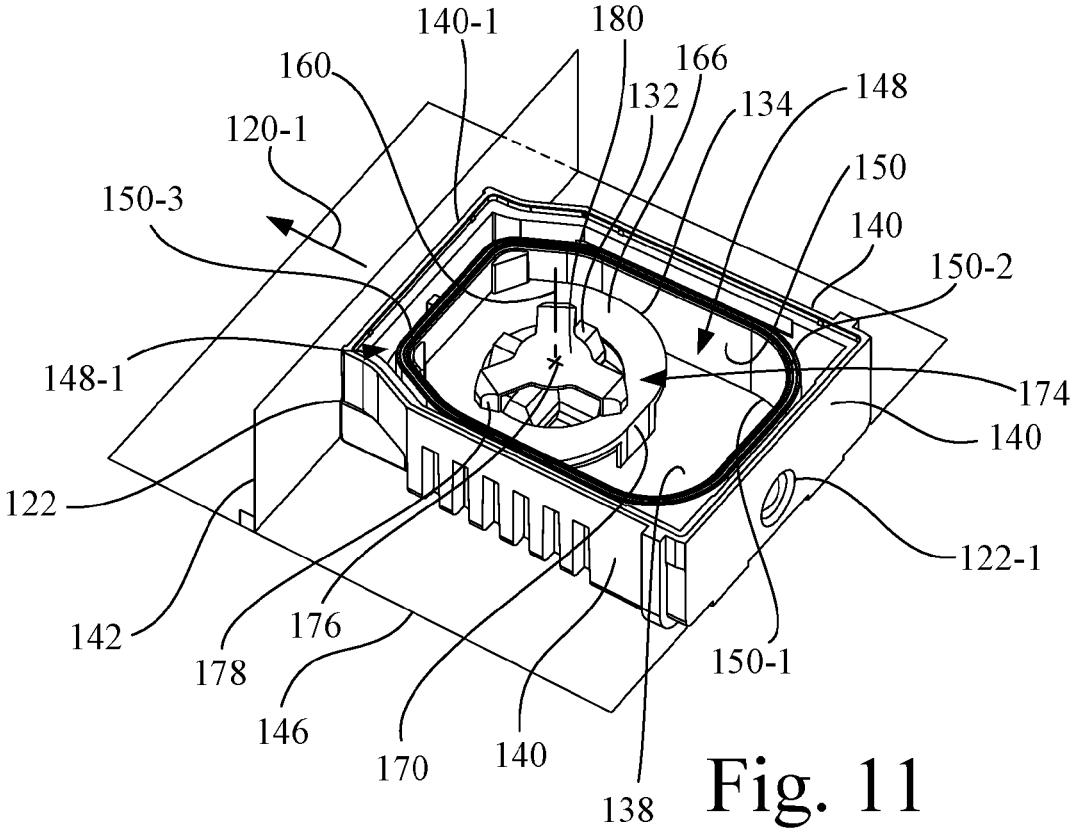
FIG. 11 is a perspective view of the depiction of FIG. 10, with the diaphragm removed to expose the guide portion and stir bar contained in the body, in relation to first and second planes and to the fluid ejection direction.

Referring also to FIGS. 8 and 9, in general, a fluid (not shown) is loaded through a fill hole 122-1 in body 122 (see also FIG. 6) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. End cap 126 is then placed onto an end of the body 122/lid 124 combination, opposite to ejection chip 118. Stir bar 132 resides in the sealed fluid reservoir 136 between body 122 and diaphragm 130 that contains the fluid. An internal fluid flow may be generated within fluid reservoir 136 by rotating stir bar 132 so as to provide fluid mixing and redistribution of particulate in the fluid within the sealed region of fluid reservoir 136.

Referring now also to FIGS. 10-16, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 occurs after installation of diaphragm 130, stir bar 132, and guide portion 134 in body 122.

Exterior perimeter wall 140 of body 122 includes an exterior wall 140-1, which is a contiguous portion of exterior perimeter wall 140. Exterior wall 140-1 has a chip mounting surface 140-2 that defines a plane 142 (see FIGS. 11 and 12), and has a fluid opening 140-3 adjacent to chip mounting surface 140-2 that passes through the thickness of exterior wall 140-1. Ejection chip 118 is mounted, e.g., by an adhesive sealing strip 144 (see FIGS. 6 and 7), to chip mounting surface 140-2 and is in fluid communication with fluid opening 140-3 (see FIG. 13) of exterior wall 140-1.

Figure 16:
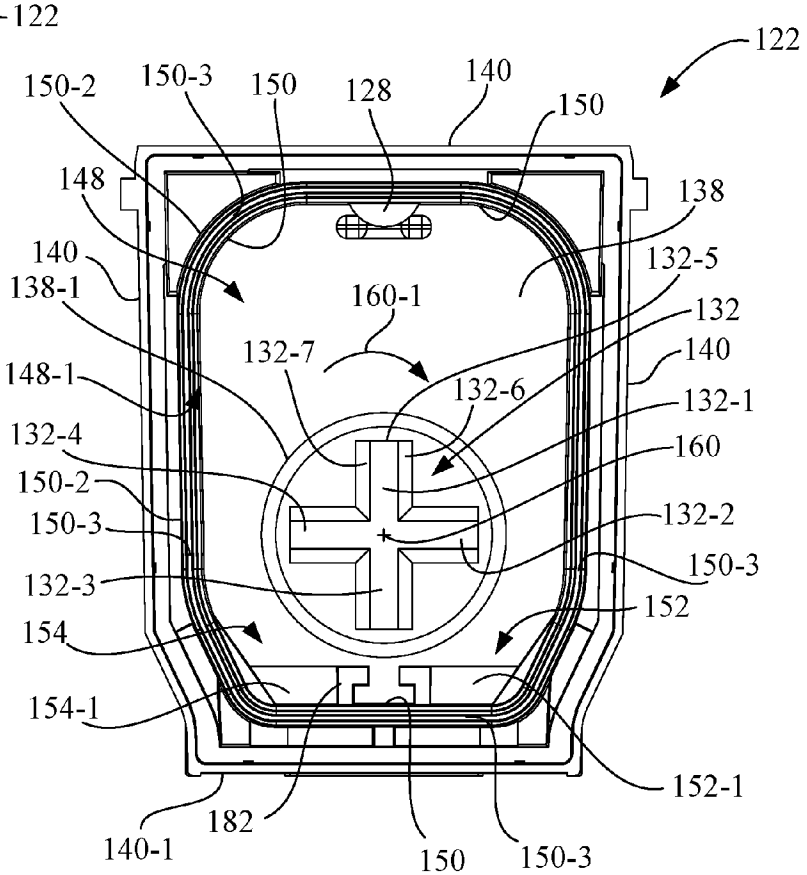
FIG. 16 is an enlarged view of the depiction of FIG. 12, with the guide portion removed to expose the stir bar residing in the chamber of the body.
Figure 15:
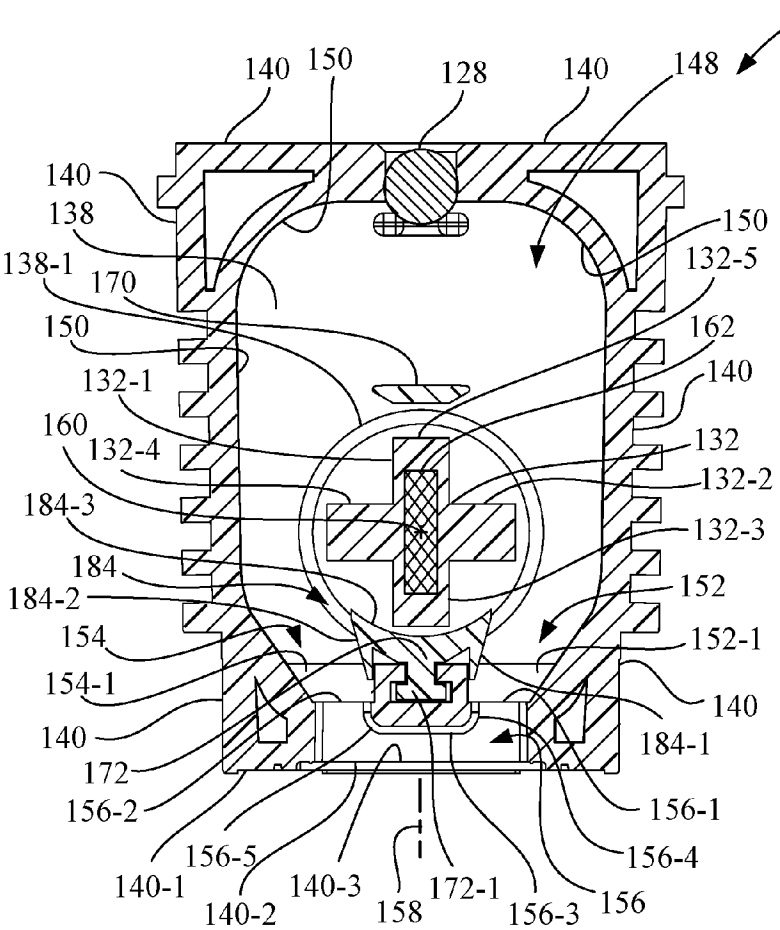
FIG. 15 is an enlarged section view of the body/guide portion/stir bar arrangement of FIGS. 12 and 13, taken along line 15-15 of FIG. 13.

Thus, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIG. 11) that is substantially orthogonal to plane 142 of exterior wall 140-1. As best shown in FIGS. 6, 15 and 16, base wall 138 may include a circular recessed region 138-1 in the vicinity of the desired location of stir bar 132.

Referring to FIGS. 11-16, body 122 of housing 112 also includes a chamber 148 located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at a lateral opening 148-1 of chamber 148. Perimetrical end surface 150-3 may include a plurality of perimetrical ribs, or undulations, to provide an effective sealing surface for engagement with diaphragm 130. The extent of interior perimetrical wall 150 of chamber 148 is substantially orthogonal to base wall 138, and is substantially parallel to the corresponding extent of exterior perimeter wall 140 (see FIG. 6).

As best shown in FIGS. 15 and 16, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of stir bar 132. However, it is to be understood that it is the rotational direction of stir bar 132 that dictates whether a particular port functions as an inlet port or an outlet port, and it is within the scope of this invention to reverse the rotational direction of stir bar 132, and thus reverse the roles of the respective ports within chamber 148.

Inlet fluid port 152 is separated a distance from outlet fluid port 154 along a portion of interior perimetrical wall 150. As best shown in FIGS. 15 and 16, considered together, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156.

In the present embodiment, referring to FIG. 15, fluid channel 156 is configured as a U-shaped elongated passage having a channel inlet 156-1 and a channel outlet 156-2. Fluid channel 156 dimensions, e.g., height and width, and shape are selected to provide a desired combination of fluid flow and fluid velocity for facilitating intra-channel stirring.

Fluid channel 156 is configured to connect inlet fluid port 152 of chamber 148 in fluid communication with outlet fluid port 154 of chamber 148, and also connects fluid opening 140-3 of exterior wall 140-1 of exterior perimeter wall 140 in fluid communication with both inlet fluid port 152 and outlet fluid port 154 of chamber 148. In particular, channel inlet 156-1 of fluid channel 156 is located adjacent to inlet fluid port 152 of chamber 148 and channel outlet 156-2 of fluid channel 156 is located adjacent to outlet fluid port 154 of chamber 148. In the present embodiment, the structure of inlet fluid port 152 and outlet fluid port 154 of chamber 148 is symmetrical.

Fluid channel 156 has a convexly arcuate wall 156-3 that is positioned between channel inlet 156-1 and channel outlet 156-2, with fluid channel 156 being symmetrical about a channel mid-point 158. In turn, convexly arcuate wall 156-3 of fluid channel 156 is positioned between inlet fluid port 152 and outlet fluid port 154 of chamber 148 on the opposite side of interior perimetrical wall 150 from the interior space of chamber 148, with convexly arcuate wall 156-3 positioned to face fluid opening 140-3 of exterior wall 140-1 and ejection chip 118.

Convexly arcuate wall 156-3 is configured to create a fluid flow through fluid channel 156 that is substantially parallel to ejection chip 118. In the present embodiment, a longitudinal extent of convexly arcuate wall 156-3 has a radius that faces fluid opening 140-3 and that is substantially parallel to ejection chip 118, and has transition radii 156-4, 156-5 located adjacent to channel inlet 156-1 and channel outlet 156-2, respectively. The radius and transition radii 156-4, 156-5 of convexly arcuate wall 156-3 help with fluid flow efficiency. A distance between convexly arcuate wall 156-3 and fluid ejection chip 118 is narrowest at the channel mid-point 158, which coincides with a mid-point of the longitudinal extent of ejection chip 118, and in turn, with a mid-point of the longitudinal extent of fluid opening 140-3 of exterior wall 140-1.

Each of inlet fluid port 152 and outlet fluid port 154 of chamber 148 has a beveled ramp structure configured such that each of inlet fluid port 152 and outlet fluid port 154 converges in a respective direction toward fluid channel 156. In particular, inlet fluid port 152 of chamber 148 has a beveled inlet ramp 152-1 configured such that inlet fluid port 152 converges, i.e., narrows, in a direction toward channel inlet 156-1 of fluid channel 156, and outlet fluid port 154 of chamber 148 has a beveled outlet ramp 154-1 that diverges, i.e., widens, in a direction away from channel outlet 156-2 of fluid channel 156.

Referring again to FIGS. 6-10, diaphragm 130 is positioned between lid 124 and perimetrical end surface 150-3 of interior perimetrical wall 150 of chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136. Thus, in combination, chamber 148 and diaphragm 130 cooperate to define fluid reservoir 136 having a variable volume.

Referring particularly to FIGS. 6, 8 and 9, an exterior surface of diaphragm 130 is vented to the atmosphere through a vent hole 124-1 located in lid 124 so that a controlled negative pressure can be maintained in fluid reservoir 136. Diaphragm 130 is made of rubber, and includes a dome portion 130-1 configured to progressively collapse toward base wall 138 as fluid is depleted from microfluidic dispensing device 110, so as to maintain a desired negative pressure in chamber 148, and thus changing the effective volume of the variable volume of fluid reservoir 136.

Referring to FIGS. 8 and 9, for sake of further explanation, below, the variable volume of fluid reservoir 136, also referred to herein as a bulk region, may be considered to have a proximal continuous ⅓ volume portion 136-1, and a continuous ⅔ volume portion 136-4 that is formed from a central continuous ⅓ volume portion 136-2 and a distal continuous ⅓ volume portion 136-3, with the continuous central volume portion 136-2 separating the proximal continuous ⅓ volume portion 136-1 from the distal continuous ⅓ volume portion 136-3. The proximal continuous ⅓ volume portion 136-1 is located closer to ejection chip 118 than the continuous ⅔ volume portion 136-4 that is formed from the central continuous ⅓ volume portion 136-2 and the distal continuous ⅓ volume portion 136-3.

Referring to FIGS. 6-9 and 16, stir bar 132 resides in the variable volume of fluid reservoir 136 and chamber 148, and is located within a boundary defined by the interior perimetrical wall 150 of chamber 148. Stir bar 132 has a rotational axis 160 and a plurality of paddles 132-1, 132-2, 132-3, 132-4 that radially extend away from the rotational axis 160. Stir bar 132 has a magnet 162 (see FIG. 8), e.g., a permanent magnet, configured for interaction with an external magnetic field generator 164 (see FIG. 1) to drive stir bar 132 to rotate around the rotational axis 160. The principle of stir bar 132 operation is that as magnet 162 is aligned to a strong enough external magnetic field generated by external magnetic field generator 164, then rotating the external magnetic field generated by external magnetic field generator 164 in a controlled manner will rotate stir bar 132. The external magnetic field generated by external magnetic field generator 164 may be rotated electronically, akin to operation of a stepper motor, or may be rotated via a rotating shaft. Thus, stir bar 132 is effective to provide fluid mixing in fluid reservoir 136 by the rotation of stir bar 132 around the rotational axis 160.

Fluid mixing in the bulk region relies on a flow velocity caused by rotation of stir bar 132 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar 132 geometry, fluid thickness between moving and stationary surfaces, and rotational speed.

Also, a fluid flow is generated by rotating stir bar 132 in a fluid region, e.g., the proximal continuous ⅓ volume portion 136-1 and fluid channel 156, associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

Stir bar 132 primarily causes rotation flow of the fluid about a central region associated with the rotational axis 160 of stir bar 132, with some axial flow with a central return path as in a partial toroidal flow pattern.

Referring to FIG. 16, each paddle of the plurality of paddles 132-1, 132-2, 132-3, 132-4 of stir bar 132 has a respective free end tip 132-5. To reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

In the present embodiment, the four paddles forming the two pairs of diametrically opposed paddles are equally spaced at 90 degree increments around the rotational axis 160. However, the actual number of paddles of stir bar 132 may be two or more, and preferably three or four, but more preferably four, with each adjacent pair of paddles having the same angular spacing around the rotational axis 160. For example, a stir bar 132 configuration having three paddles may have a paddle spacing of 120 degrees, having four paddles may have a paddle spacing of 90 degrees, etc.

In the present embodiment, and with the variable volume of fluid reservoir 136 being divided as the proximal continuous ⅓ volume portion 136-1 and the continuous ⅔ volume portion 136-4 described above, with the proximal continuous ⅓ volume portion 136-1 being located closer to ejection chip 118 than the ⅔ volume portion 136-4, the rotational axis 160 of stir bar 132 may be located in the proximal continuous ⅓ volume portion 136-1 that is closer to ejection chip 118. Stated differently, guide portion 134 is configured to position the rotational axis 160 of stir bar 132 in a portion of the interior space of chamber 148 that constitutes a ⅓ of the volume of the interior space of chamber 148 that is closest to fluid opening 140-3.

Referring again also to FIG. 11, the rotational axis 160 of stir bar 132 may be oriented in an angular range of perpendicular, plus or minus 45 degrees, relative to the fluid ejection direction 120-1. Stated differently, the rotational axis 160 of stir bar 132 may be oriented in an angular range of parallel, plus or minus 45 degrees, relative to the planar extent (e.g., plane 142) of ejection chip 118. In combination, the rotational axis 160 of stir bar 132 may be oriented in both an angular range of perpendicular, plus or minus 45 degrees, relative the fluid ejection direction 120-1, and an angular range of parallel, plus or minus 45 degrees, relative to the planar extent of ejection chip 118.

More preferably, the rotational axis 160 has an orientation substantially perpendicular to the fluid ejection direction 120-1, and thus, the rotational axis 160 of stir bar 132 has an orientation that is substantially parallel to plane 142, i.e., planar extent, of ejection chip 118 and that is substantially perpendicular to plane 146 of base wall 138. Also, in the present embodiment, the rotational axis 160 of stir bar 132 has an orientation that is substantially perpendicular to plane 146 of base wall 138 in all orientations around rotational axis 160 and is substantially perpendicular to the fluid ejection direction 120-1.

Referring to FIGS. 6-9, 11, and 12, the orientations of stir bar 132, described above, may be achieved by guide portion 134, with guide portion 134 also being located within chamber 148 in the variable volume of fluid reservoir 136 (see FIGS. 8 and 9), and more particularly, within the boundary defined by interior perimetrical wall 150 of chamber 148. Guide portion 134 is configured to confine stir bar 132 in a predetermined portion of the interior space of chamber 148 at a predefined orientation, as well as to split and redirect the rotational fluid flow from stir bar 132 towards channel inlet 156-1 of fluid channel 156. On the return flow side, guide portion 134 helps to recombine the rotational flow received from channel outlet 156-2 of fluid channel 156 in the bulk region of fluid reservoir 136.

For example, guide portion 134 may be configured to position the rotational axis 160 of stir bar 132 in an angular range of parallel, plus or minus 45 degrees, relative to the planar extent of ejection chip 118, and more preferably, guide portion 134 is configured to position the rotational axis 160 of stir bar 132 substantially parallel to the planar extent of ejection chip 118. In the present embodiment, guide portion 134 is configured to position and maintain an orientation of the rotational axis 160 of stir bar 132 to be substantially parallel to the planar extent of ejection chip 118 and to be substantially perpendicular to plane 146 of base wall 138 in all orientations around rotational axis 160.

Guide portion 134 includes an annular member 166, a plurality of locating features 168-1, 168-2, offset members 170, 172, and a cage structure 174. The plurality of locating features 168-1, 168-2 are positioned on the opposite side of annular member 166 from offset members 170, 172, and are positioned to be engaged by diaphragm 130, which keeps offset members 170, 172 in contact with base wall 138. Offset members 170, 172 maintain an axial position (relative to the rotational axis 160 of stir bar 132) of guide portion 134 in fluid reservoir 136. Offset member 172 includes a retaining feature 172-1 that engages body 122 to prevent a lateral translation of guide portion 134 in fluid reservoir 136.

Referring again to FIGS. 6 and 7, annular member 166 of guide portion 134 has a first annular surface 166-1, a second annular surface 166-2, and an opening 166-3 that defines an annular confining surface 166-4. Opening 166-3 of annular member 166 has a central axis 176. Annular confining surface 166-4 is configured to limit radial movement of stir bar 132 relative to the central axis 176. Second annular surface 166-2 is opposite first annular surface 166-1, with first annular surface 166-1 being separated from second annular surface 166-2 by annular confining surface 166-4. Referring also to FIG. 9, first annular surface 166-1 of annular member 166 also serves as a continuous ceiling over, and between, inlet fluid port 152 and outlet fluid port 154. The plurality of offset members 170, 172 are coupled to annular member 166, and more particularly, the plurality of offset members 170, 172 are connected to first annular surface 166-1 of annular member 166. The plurality of offset members 170, 172 are positioned to extend from annular member 166 in a first axial direction relative to the central axis 176. Each of the plurality of offset members 170, 172 has a free end configured to engage base wall 138 of chamber 148 to establish an axial offset of annular member 166 from base wall 138. Offset member 172 also is positioned and configured to aid in preventing a flow bypass of fluid channel 156.

The plurality of offset members 170, 172 are coupled to annular member 166, and more particularly, the plurality of offset members 170, 172 are connected to second annular surface 166-2 of annular member 166. The plurality of offset members 170, 172 are positioned to extend from annular member 166 in a second axial direction relative to the central axis 176, opposite to the first axial direction.

Thus, when assembled, each of locating features 168-1, 168-2 has a free end that engages a perimetrical portion of diaphragm 130, and each of the plurality of offset members 170, 172 have a free end that engages base wall 138.

Figure 12:
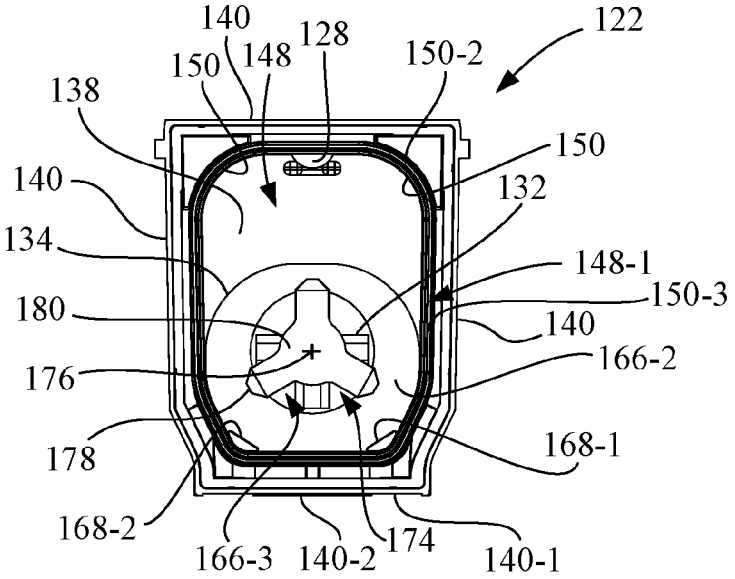
FIG. 12 is an orthogonal view of the body/guide portion/stir bar arrangement of FIG. 11, as viewed in a direction into the body of the chamber toward the base wall of the body.
Figure 13:
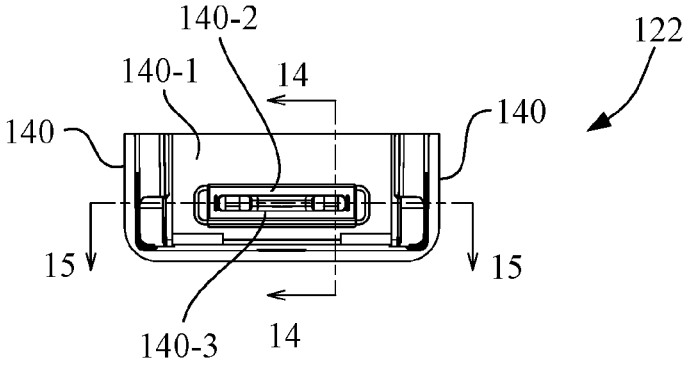
FIG. 13 is an orthogonal end view of the body of FIG. 11, which contains the guide portion and stir bar, as viewed in a direction toward the exterior wall and opening of the body.

Cage structure 174 of guide portion 134 is coupled to annular member 166 opposite to the plurality of offset members 170, 172, and more particularly, the cage structure 174 has a plurality of offset legs 178 connected to second annular surface 166-2 of annular member 166. Cage structure 174 has an axial restraint portion 180 that is axially displaced by the plurality of offset legs 178 (three, as shown) from annular member 166 in the second axial direction opposite to the first axial direction. As shown in FIG. 12, axial restraint portion 180 is positioned over at least a portion of the opening 166-3 in annular member 166 to limit axial movement of stir bar 132 relative to the central axis 176 in the second axial direction. Cage structure 174 also serves to prevent diaphragm 130 from contacting stir bar 132 as diaphragm displacement (collapse) occurs during fluid depletion from fluid reservoir 136.

As such, in the present embodiment, stir bar 132 is confined in a free-floating manner within the region defined by opening 166-3 and annular confining surface 166-4 of annular member 166, and between axial restraint portion 180 of the cage structure 174 and base wall 138 of chamber 148. The extent to which stir bar 132 is free-floating is determined by the radial tolerances provided between annular confining surface 166-4 and stir bar 132 in the radial direction, and by the axial tolerances between stir bar 132 and the axial limit provided by the combination of base wall 138 and axial restraint portion 180. For example, the tighter the radial and axial tolerances provided by guide portion 134, the less variation of the rotational axis 160 of stir bar 132 from perpendicular relative to base wall 138, and the less side-to-side motion of stir bar 132 within fluid reservoir 136.

In the present embodiment, guide portion 134 is configured as a unitary insert member that is removably attached to housing 112. Guide portion 134 includes retention feature 172-1 and body 122 of housing 112 includes a second retention feature 182. First retention feature 172-1 is engaged with second retention feature 182 to attach guide portion 134 to body 122 of housing 112 in a fixed relationship with housing 112. The first retention feature 172-1/second retention feature 182 may be, for example, in the form of a tab/slot arrangement, or alternatively, a slot/tab arrangement, respectively.

Referring to FIGS. 7 and 15, guide portion 134 may further include a flow control portion 184, which in the present embodiment, also serves as offset 172. Referring to FIG. 15, flow control portion 184 has a flow separator feature 184-1, a flow rejoining feature 184-2, and a concavely arcuate surface 184-3. Concavely arcuate surface 184-3 is coextensive with, and extends between, each of flow separator feature 184-1 and flow rejoining feature 184-2. Each of flow separator feature 184-1 and flow rejoining feature 184-2 is defined by a respective angled, i.e., beveled, wall. Flow separator feature 184-1 is positioned adjacent inlet fluid port 152 and flow rejoining feature 184-2 is positioned adjacent outlet fluid port 154.

Figure 14:
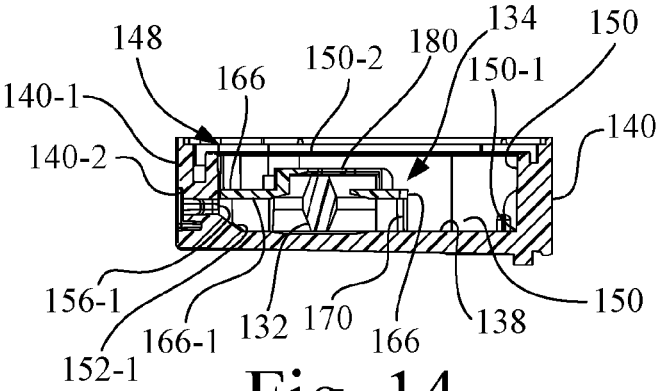
FIG. 14 is a section view of the body/guide portion/stir bar arrangement of FIGS. 12 and 13, taken along line 14-14 of FIG. 13.

The beveled wall of flow separator feature 184-1 positioned adjacent to inlet fluid port 152 of chamber 148 cooperates with beveled inlet ramp 152-1 of inlet fluid port 152 of chamber 148 to guide fluid toward channel inlet 156-1 of fluid channel 156. Flow separator feature 184-1 is configured such that the rotational flow is directed toward channel inlet 156-1 instead of allowing a direct bypass of fluid into the outlet fluid that exits channel outlet 156-2. Referring also to FIGS. 9 and 14, positioned opposite beveled inlet ramp 152-1 is the fluid ceiling provided by first annular surface 166-1 of annular member 166. Flow separator feature 184-1 in combination with the continuous ceiling of annular member 166 and beveled ramp wall provided by beveled inlet ramp 152-1 of inlet fluid port 152 of chamber 148 aids in directing a fluid flow into channel inlet 156-1 of fluid channel 156.

Likewise, referring to FIGS. 9, 14 and 15, the beveled wall of flow rejoining feature 184-2 positioned adjacent to outlet fluid port 154 of chamber 148 cooperates with beveled outlet ramp 154-1 of outlet fluid port 154 to guide fluid away from channel outlet 156-2 of fluid channel 156. Positioned opposite beveled outlet ramp 154-1 is the fluid ceiling provided by first annular surface 166-1 of annular member 166.

In the present embodiment, flow control portion 184 is a unitary structure formed as offset member 172 of guide portion 134. Alternatively, all or a portion of flow control portion 184 may be incorporated into interior perimetrical wall 150 of chamber 148 of body 122 of housing 112.

In the present embodiment, as best shown in FIGS. 15 and 16, stir bar 132 is oriented such that the plurality of paddles 132-1, 132-2, 132-3, 132-4 periodically face the concavely arcuate surface 184-3 of the flow control portion 184 as stir bar 132 is rotated about the rotational axis 160. Stir bar 132 has a stir bar radius from rotational axis 160 to the free end tip 132-5 of a respective paddle. A ratio of the stir bar radius and a clearance distance between the free end tip 132-5 and flow control portion 184 may be 5:2 to 5:0.025. More particularly, guide portion 134 is configured to confine stir bar 132 in a predetermined portion of the interior space of chamber 148. In the present example, a distance between the respective free end tip 132-5 of each of the plurality of paddles 132-1, 132-2, 132-3, 132-4 and concavely arcuate surface 184-3 of flow control portion 184 is in a range of 2.0 millimeters to 0.1 millimeters, and more preferably, is in a range of 1.0 millimeters to 0.1 millimeters, as the respective free end tip 132-5 faces concavely arcuate surface 184-3. Also, it has been found that it is preferred to position stir bar 132 as close to ejection chip 118 as possible so as to maximize flow through fluid channel 156.

Also, guide portion 134 is configured to position the rotational axis 160 of stir bar 132 in a portion of fluid reservoir 136 such that the free end tip 132-5 of each of the plurality of paddles 132-1, 132-2, 132-3, 132-4 of stir bar 132 rotationally ingresses and egresses a proximal continuous ⅓ volume portion 136-1 that is closer to ejection chip 118. Stated differently, guide portion 134 is configured to position the rotational axis 160 of stir bar 132 in a portion of the interior space such that the free end tip 132-5 of each of the plurality of paddles 132-1, 132-2, 132-3, 132-4 rotationally ingresses and egresses the continuous ⅓ volume portion 136-1 of the interior space of chamber 148 that includes inlet fluid port 152 and outlet fluid port 154.

More particularly, in the present embodiment, wherein stir bar 132 has four paddles, guide portion 134 is configured to position the rotational axis 160 of stir bar 132 in a portion of the interior space such that the first and second free end tips 132-5 of each the two pairs of diametrically opposed paddles 132-1, 132-3 and 132-2, 132-4 alternatingly and respectively are positioned in the proximal continuous ⅓ portion 136-1 of the volume of the interior space of chamber 148 that includes inlet fluid port 152 and outlet fluid port 154 and in the continuous ⅔ volume portion 136-4 having the distal continuous ⅓ portion 136-3 of the interior space that is furthest from ejection chip 118.

FIGS. 17-27 depict another embodiment of the invention, which in the present example is in the form of a microfluidic dispensing device 210. Elements common to both microfluidic dispensing device 110 and microfluidic dispensing device 210 are identified using common element numbers, and for brevity, are not described again below in full detail.

Microfluidic dispensing device 210 generally includes a housing 212 and TAB circuit 114, with microfluidic dispensing device 210 configured to contain a supply of a fluid, such as a particulate carrying fluid, and with TAB circuit 114 configured to facilitate the ejection of the fluid from housing 212.

Figure 17:
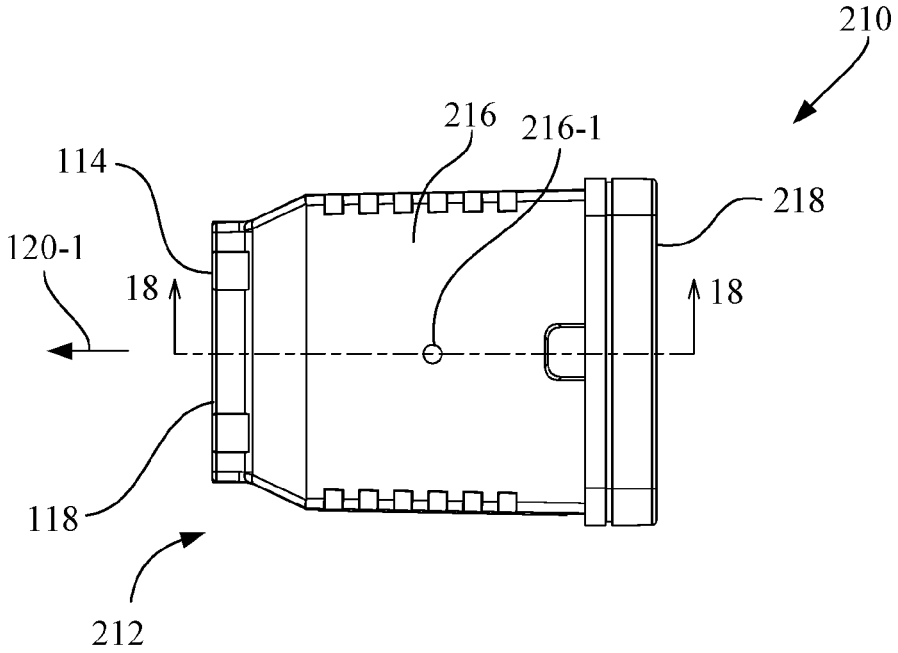
FIG. 17 is a top view of another embodiment of a microfluidic dispensing device in accordance with the present invention.
Figure 18:
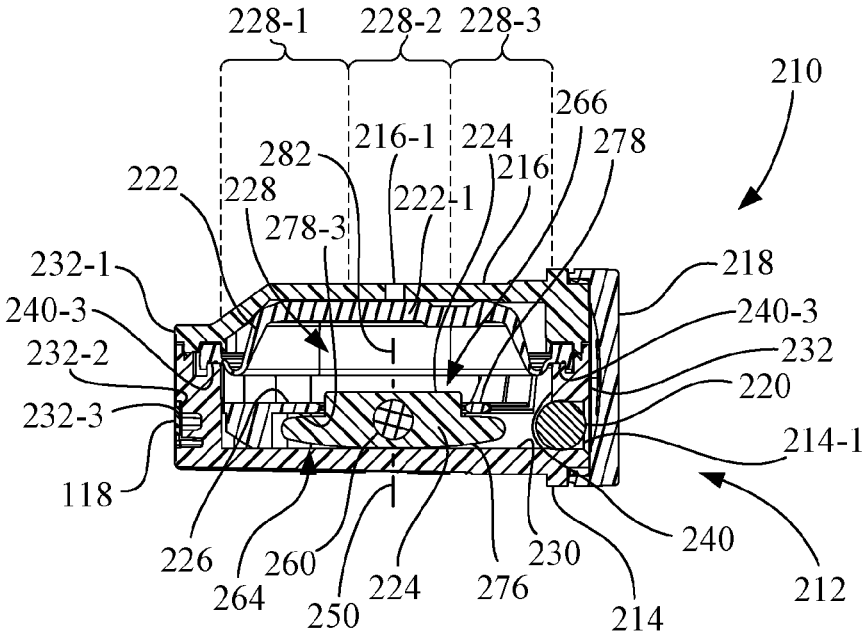
FIG. 18 is a section view of the microfluidic dispensing device of FIG. 17, taken along line 18-18 of FIG. 17.
Figure 19:
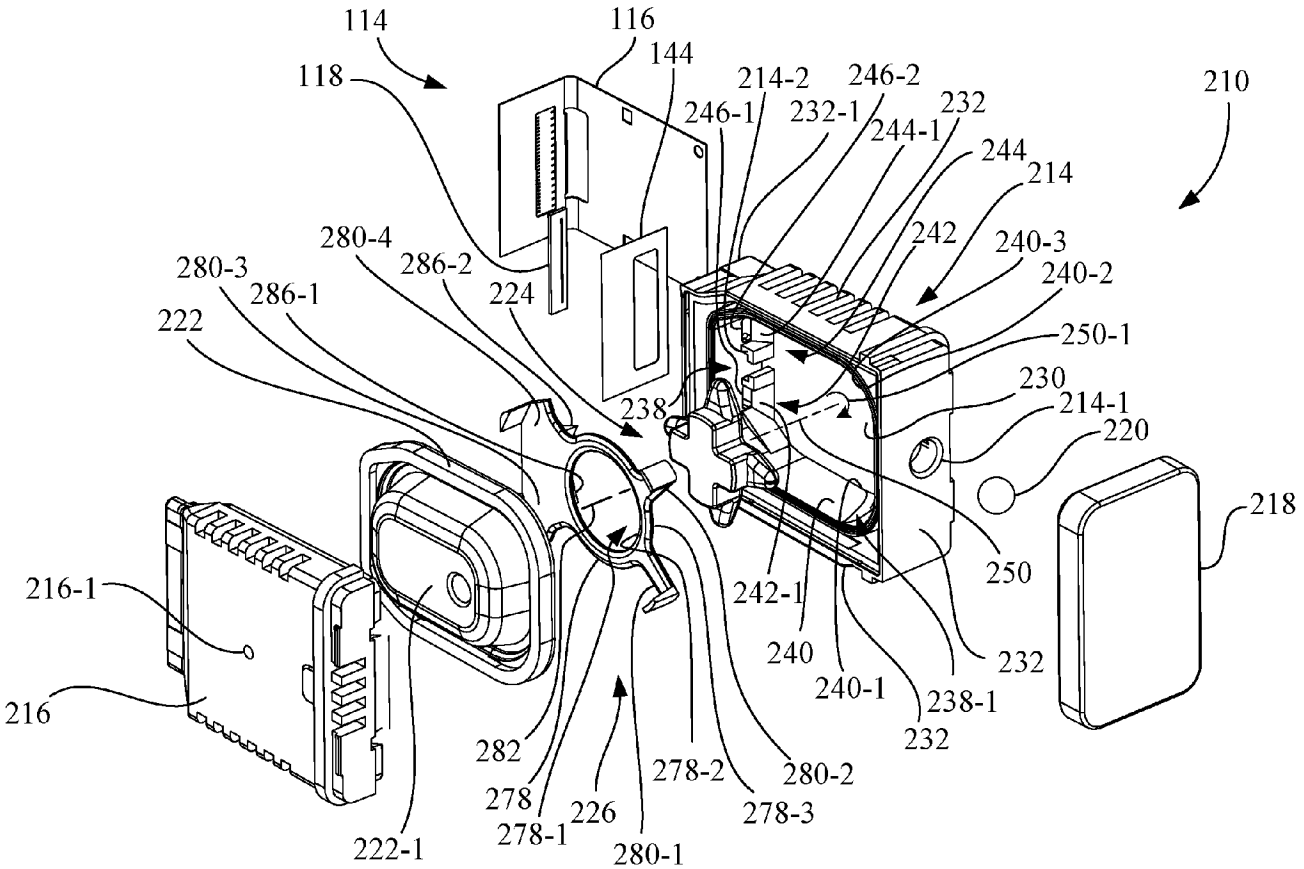
FIG. 19 is an exploded perspective view of the microfluidic dispensing device of FIG. 17, oriented for viewing into the chamber of the body in a direction toward the ejection chip.

As best shown in FIGS. 17-19, housing 212 includes a body 214, a lid 216, an end cap 218, and a fill plug 220 (e.g., ball). Contained within housing 212 is a diaphragm 222, a stir bar 224, and a guide portion 226. Each of housing 212 components, stir bar 224, and guide portion 226 may be made of plastic, using a molding process. Diaphragm 222 is made of rubber, using a molding process. Also, in the present embodiment, fill plug 220 may be in the form of a stainless steel ball bearing.

Referring to FIG. 18, in general, a fluid (not shown) is loaded through a fill hole 214-1 in body 214 (see FIG. 6) into a sealed region, i.e., a fluid reservoir 228, between body 214 and diaphragm 222. Back pressure in fluid reservoir 228 is set and then maintained by inserting, e.g., pressing, fill plug 220 into fill hole 214-1 to prevent air from leaking into fluid reservoir 228 or fluid from leaking out of fluid reservoir 228. End cap 218 is then placed onto an end of the body 214/lid 216 combination, opposite to ejection chip 118. Stir bar 224 resides in the sealed fluid reservoir 228 between body 214 and diaphragm 222 that contains the fluid. An internal fluid flow may be generated within fluid reservoir 228 by rotating stir bar 224 so as to provide fluid mixing and redistribution of particulate within the sealed region of fluid reservoir 228.

Figure 20:
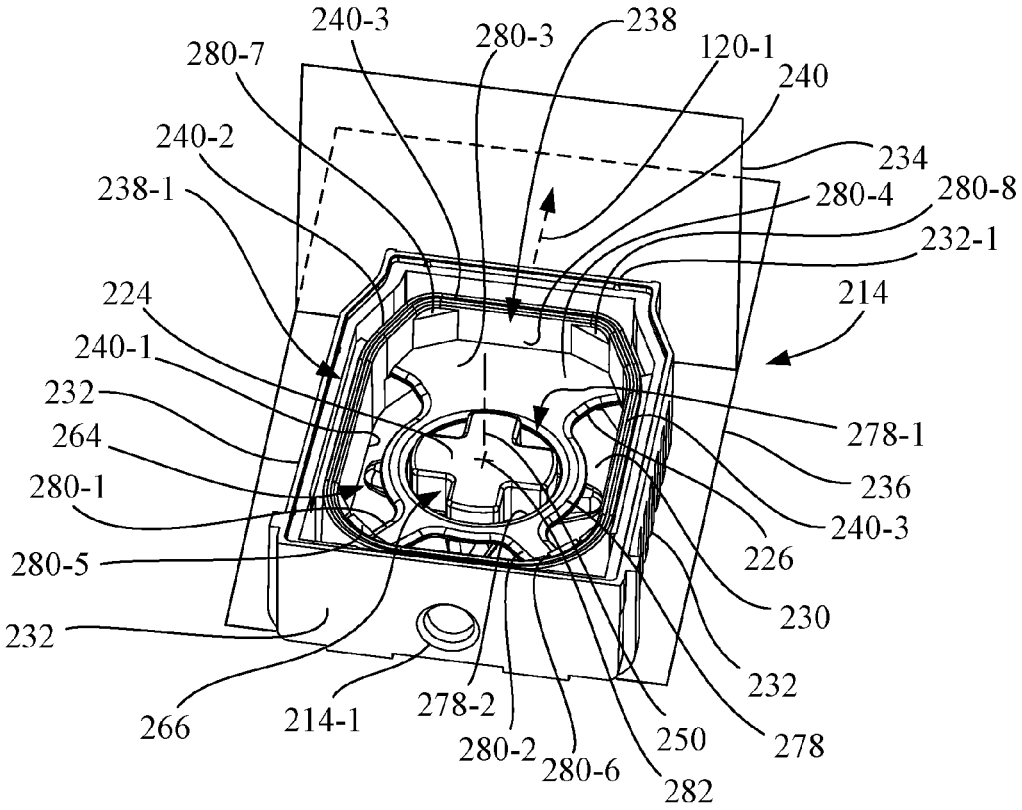
FIG. 20 is another perspective view of the microfluidic dispensing device of FIG. 17, with the end cap, lid and diaphragm removed to expose the guide portion and stir bar contained in the body, shown in relation to first and second planes and the fluid ejection direction.
Figure 21:
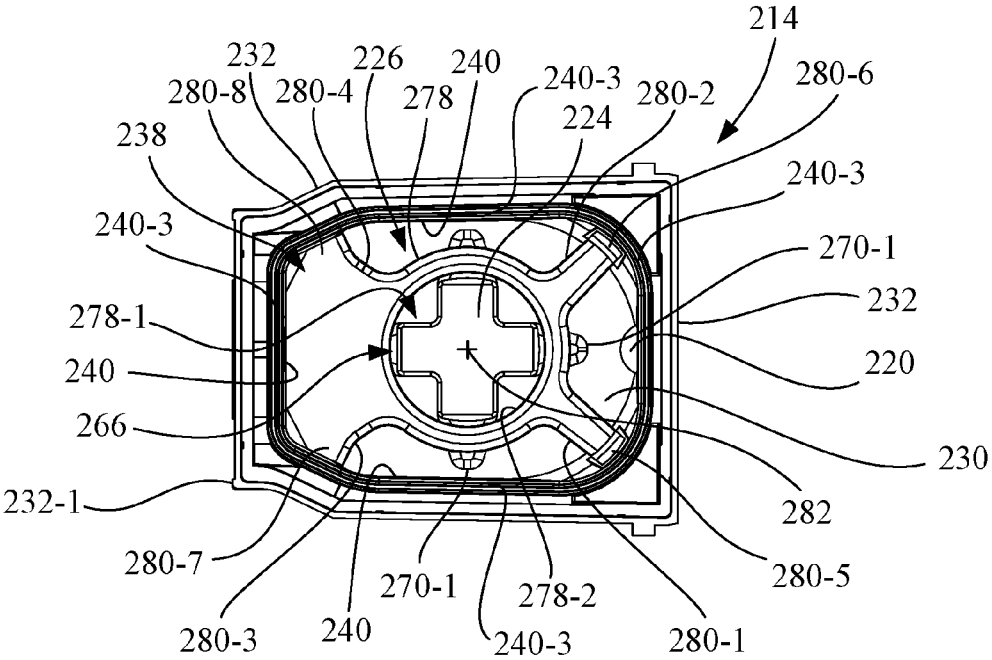
FIG. 21 is an orthogonal top view corresponding to the perspective view of FIG. 20, showing the body having a chamber that contains the guide portion and the stir bar.

Referring now also to FIGS. 20 and 21, body 214 of housing 212 has a base wall 230 and an exterior perimeter wall 232 contiguous with base wall 230. Exterior perimeter wall 232 is oriented to extend from base wall 230 in a direction that is substantially orthogonal to base wall 230. Referring to FIG. 19, lid 216 is configured to engage exterior perimeter wall 232. Thus, exterior perimeter wall 232 is interposed between base wall 230 and lid 216, with lid 216 being attached to the open free end of exterior perimeter wall 232 by weld, adhesive, or other fastening mechanism, such as a snap fit or threaded union.

Figure 23:
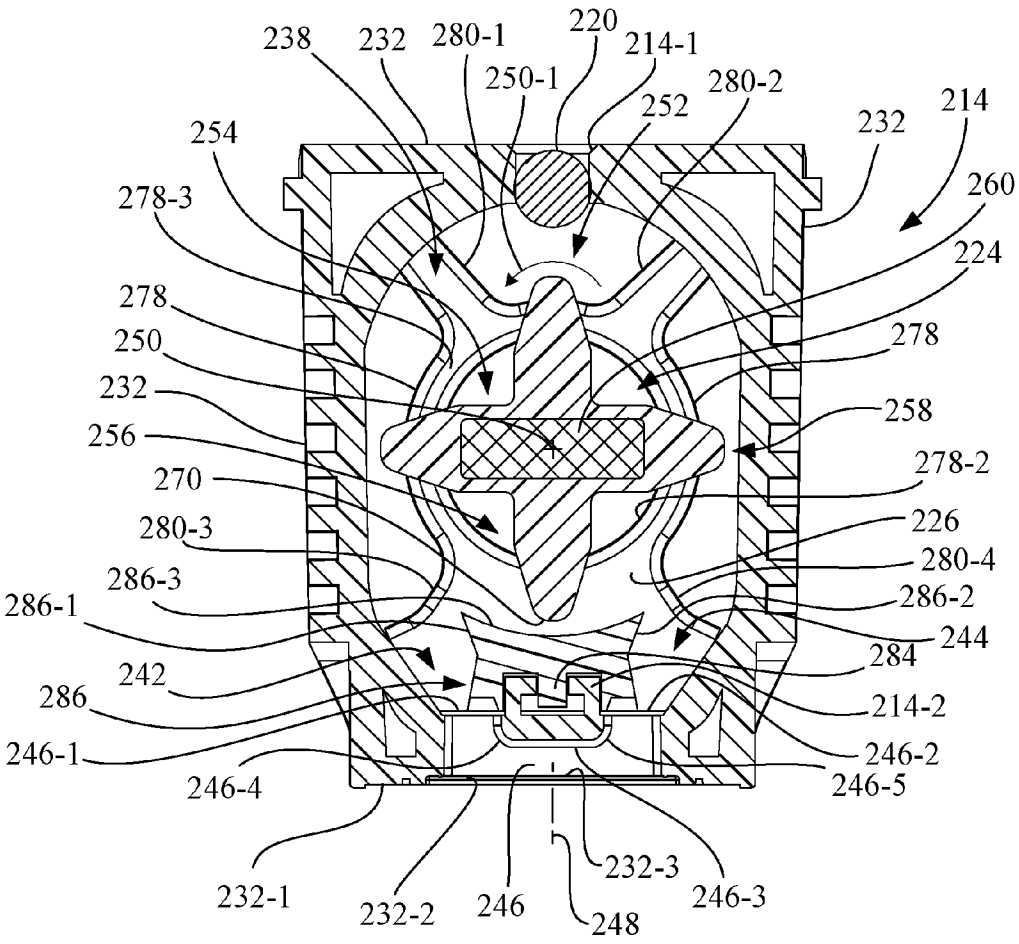
FIG. 23 is a section view taken along line 23-23 of FIG. 22.
Figure 22:
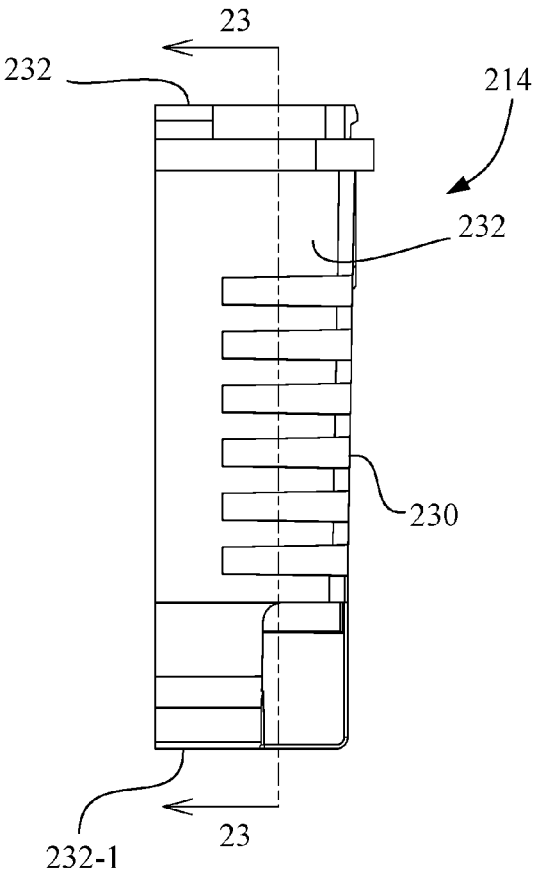
FIG. 22 is a side orthogonal view of the body of the microfluidic dispensing device of FIG. 17, wherein the body contains the guide portion and the stir bar.
Figure 24:
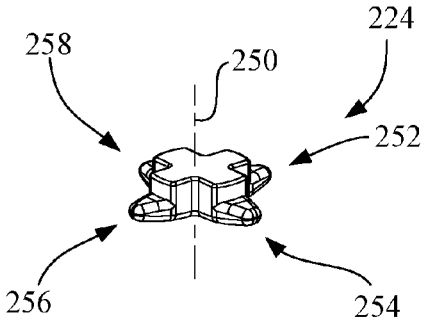
FIG. 24 is a perspective view of an embodiment of the stir bar of the microfluidic dispensing device of FIG. 17, as further depicted in FIGS. 18-21 and 23.

Referring also to FIGS. 18, 22 and 23, exterior perimeter wall 232 of body 214 includes an exterior wall 232-1, which is a contiguous portion of exterior perimeter wall 232. Exterior wall 232-1 has a chip mounting surface 232-2 and a fluid opening 232-3 adjacent to chip mounting surface 232-2 that passes through the thickness of exterior wall 232-1.

Referring again also to FIG. 20, chip mounting surface 232-2 defines a plane 234. Ejection chip 118 is mounted to chip mounting surface 232-2 and is in fluid communication with fluid opening 232-3 of exterior wall 232-1. An adhesive sealing strip 144 holds ejection chip 118 and TAB circuit 114 in place while a dispensed adhesive under ejection chip 118, and the encapsulant to protect the electrical leads, is cured. After the cure cycle, the liquid seal between ejection chip 118 and chip mounting surface 232-2 of body 214 is the die bond adhesive.

The planar extent of ejection chip 118 is oriented along the plane 234, with the plurality of ejection nozzles 120 (see e.g., FIG. 1) oriented such that the fluid ejection direction 120-1 is substantially orthogonal to the plane 234. Base wall 230 is oriented along a plane 236 that is substantially orthogonal to the plane 234 of exterior wall 232-1, and is substantially parallel to the fluid ejection direction 120-1.

As best illustrated in FIG. 20, body 214 of housing 212 includes a chamber 238 located within a boundary defined by exterior perimeter wall 232. Chamber 238 forms a portion of fluid reservoir 228, and is configured to define an interior space, and in particular, includes base wall 230 and has an interior perimetrical wall 240 configured to have rounded corners, so as to promote fluid flow in chamber 238. Referring to FIG. 19, interior perimetrical wall 240 of chamber 238 has an extent bounded by a proximal end 240-1 and a distal end 240-2. Proximal end 240-1 is contiguous with, and preferably forms a transition radius with, base wall 230. Distal end 240-2 is configured to define a perimetrical end surface 240-3 at a lateral opening 238-1 of chamber 238. Perimetrical end surface 240-3 may include a plurality of ribs, or undulations, to provide an effective sealing surface for engagement with diaphragm 222. The extent of interior perimetrical wall 240 of chamber 238 is substantially orthogonal to base wall 230, and is substantially parallel to the corresponding extent of exterior perimeter wall 232.

As best shown in FIG. 19, chamber 238 has an inlet fluid port 242 and an outlet fluid port 244, each of which is formed in a portion of interior perimetrical wall 240. Inlet fluid port 242 is separated a distance from outlet fluid port 244 along the portion of interior perimetrical wall 240. The terms "inlet" and "outlet" are terms of convenience that are used in distinguishing between the multiple ports of the present embodiment, and are correlated with a particular rotational direction 250-1 of stir bar 224. However, it is to be understood that it is the rotational direction of stir bar 224 that dictates whether a particular port functions as an inlet port or an outlet port, and it is within the scope of this invention to reverse the rotational direction of stir bar 224, and thus reverse the roles of the respective ports within chamber 238.

As best shown in FIG. 23, body 214 of housing 212 includes a fluid channel 246 interposed between a portion of interior perimetrical wall 240 of chamber 238 and exterior wall 232-1 of exterior perimeter wall 232 that carries ejection chip 118. Fluid channel 246 is configured to minimize particulate settling in a region of fluid opening 232-3, and in turn, ejection chip 118.

In the present embodiment, fluid channel 246 is configured as a U-shaped elongated passage having a channel inlet 246-1 and a channel outlet 246-2. Fluid channel 246 dimensions, e.g., height and width, and shape are selected to provide a desired combination of fluid flow and fluid velocity for facilitating intra-channel stirring.

Fluid channel 246 is configured to connect inlet fluid port 242 of chamber 238 in fluid communication with outlet fluid port 244 of chamber 238, and also connects fluid opening 232-3 of exterior wall 232-1 of exterior perimeter wall 232 in fluid communication with both inlet fluid port 242 and outlet fluid port 244 of chamber 238. In particular, channel inlet 246-1 of fluid channel 246 is located adjacent to inlet fluid port 242 of chamber 238 and channel outlet 246-2 of fluid channel 246 is located adjacent to outlet fluid port 244 of chamber 238. In the present embodiment, the structure of inlet fluid port 242 and outlet fluid port 244 of chamber 238 is symmetrical.

Fluid channel 246 has a convexly arcuate wall 246-3 that is positioned between channel inlet 246-1 and channel outlet 246-2, with fluid channel 246 being symmetrical about a channel mid-point 248. In turn, convexly arcuate wall 246-3 of fluid channel 246 is positioned between inlet fluid port 242 and outlet fluid port 244 of chamber 238 on the opposite side of interior perimetrical wall 240 from the interior space of chamber 238, with convexly arcuate wall 246-3 positioned to face fluid opening 232-3 of exterior wall 232-1 and fluid ejection chip 118.

Convexly arcuate wall 246-3 is configured to create a fluid flow substantially parallel to ejection chip 118. In the present embodiment, a longitudinal extent of convexly arcuate wall 246-3 has a radius that faces fluid opening 232-3, is substantially parallel to ejection chip 118, and has transition radii 246-4, 246-5 located adjacent to channel inlet 246-1 and channel outlet 246-2 surfaces, respectively. The radius and radii of convexly arcuate wall 246-3 help with fluid flow efficiency. A distance between convexly arcuate wall 246-3 and fluid ejection chip 118 is narrowest at the channel mid-point 248, which coincides with a mid-point of the longitudinal extent of fluid ejection chip 118, and in turn, with at a mid-point of the longitudinal extent of fluid opening 232-3 of exterior wall 232-1.

Referring again also to FIG. 19, each of inlet fluid port 242 and outlet fluid port 244 of chamber 238 has a beveled ramp structure configured such that each of inlet fluid port 242 and outlet fluid port 244 converges in a respective direction toward fluid channel 246. In particular, inlet fluid port 242 of chamber 238 has a beveled inlet ramp 242-1 configured such that inlet fluid port 242 converges, i.e., narrows, in a direction toward channel inlet 246-1 of fluid channel 246, and outlet fluid port 244 of chamber 238 has a beveled outlet ramp 244-1 that diverges, i.e., widens, in a direction away from channel outlet 246-2 of fluid channel 246.

Referring again to FIG. 18, diaphragm 222 is positioned between lid 216 and perimetrical end surface 240-3 of interior perimetrical wall 240 of chamber 238. The attachment of lid 216 to body 214 compresses a perimeter of diaphragm 222 thereby creating a continuous seal between diaphragm 222 and body 122, and more particularly, diaphragm 222 is configured for sealing engagement with perimetrical end surface 240-3 of interior perimetrical wall 240 of chamber 238 in forming fluid reservoir 228. Thus, in combination, chamber 148 and diaphragm 222 cooperate to define fluid reservoir 228 having a variable volume.

Referring particularly to FIGS. 18 and 19, an exterior surface of diaphragm 222 is vented to the atmosphere through a vent hole 216-1 located in lid 216 so that a controlled negative pressure can be maintained in fluid reservoir 228. Diaphragm 222 is made of rubber, and includes a dome portion 222-1 configured to progressively collapse toward base wall 230 as fluid is depleted from microfluidic dispensing device 210, so as to maintain a desired negative pressure in chamber 238, and thus changing the effective volume of the variable volume of fluid reservoir 228.

Referring to FIG. 18, for sake of further explanation, below, the variable volume of fluid reservoir 228, also referred to herein as a bulk region, may be considered to have a proximal continuous ⅓ volume portion 228-1, a central continuous ⅓ volume portion 228-2, and a distal continuous ⅓ volume portion 228-3, with the continuous central volume portion 228-2 separating the proximal continuous ⅓ volume portion 228-1 from the distal continuous ⅓ volume portion 228-3. The proximal continuous ⅓ volume portion 228-1 is located closer to ejection chip 118 than either of the central continuous ⅓ volume portion 228-2 and the distal continuous ⅓ volume portion 228-3.

Referring to FIGS. 18 and 19, stir bar 224 resides in the variable volume of fluid reservoir 228 and in chamber 238, and is located within a boundary defined by interior perimetrical wall 240 of chamber 238. Referring also to FIGS. 24-27, stir bar 224 has a rotational axis 250 and a plurality of paddles 252, 254, 256, 258 that radially extend away from the rotational axis 250. Stir bar 224 has a magnet 260 (see FIGS. 18, 23, and 27), e.g., a permanent magnet, configured for interaction with external magnetic field generator 164 (see FIG. 1) to drive stir bar 224 to rotate around the rotational axis 250. In the present embodiment, stir bar 224 has two pairs of diametrically opposed paddles that are equally spaced at 90 degree increments around rotational axis 250. However, the actual number of paddles of stir bar 224 is two or more, and preferably three or four, but more preferably four, with each adjacent pair of paddles having the same angular spacing around the rotational axis 250. For example, a stir bar 224 configuration having three paddles would have a paddle spacing of 120 degrees, having four paddles would have a paddle spacing of 90 degrees, etc.

Figure 25:
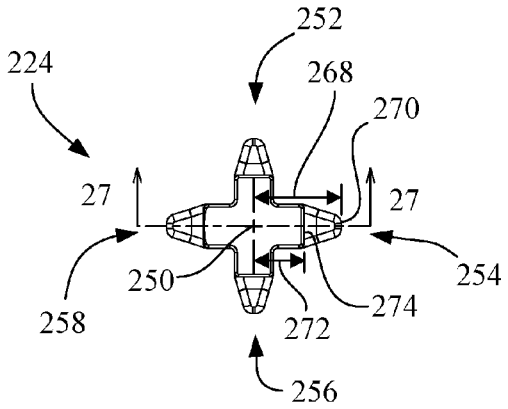
FIG. 25 is a top view of the stir bar of FIG. 24.
Figure 26:
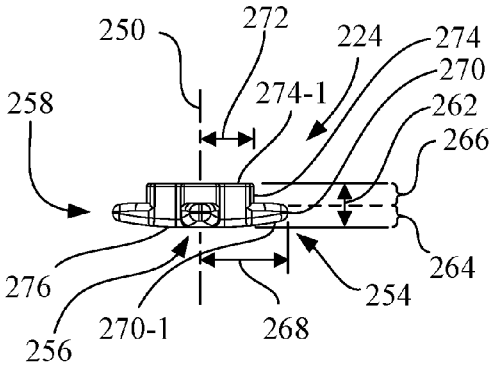
FIG. 26 is a side view of the stir bar of FIG. 24.
Figure 27:
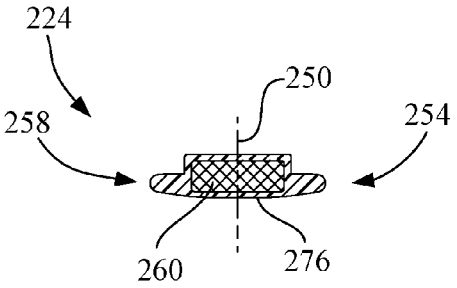
FIG. 27 is a section view of the stir bar taken along line 27-27 of FIG. 25.
Figure 28:
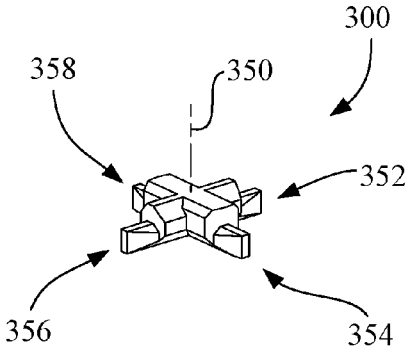
FIG. 28 is a perspective view of another embodiment of a stir bar suitable for use in the microfluidic dispensing device of FIG. 17.
Figure 29:
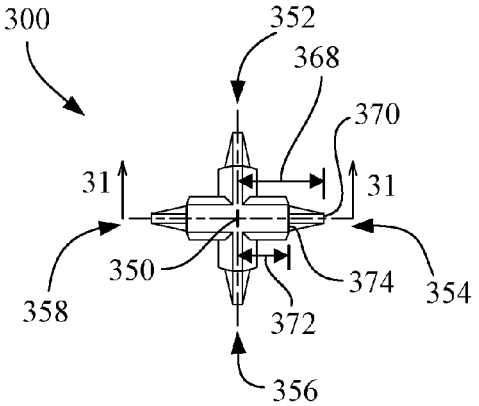
FIG. 29 is a top view of the stir bar of FIG. 28.
Figure 30:
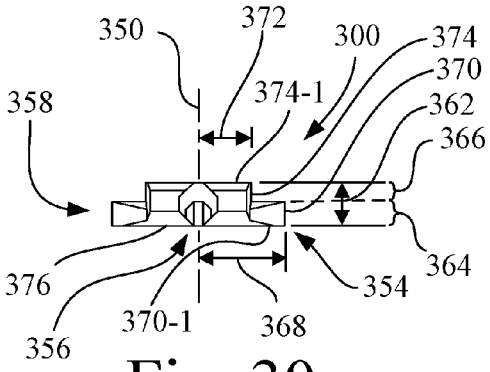
FIG. 30 is a side view of the stir bar of FIG. 28.
Figure 31:
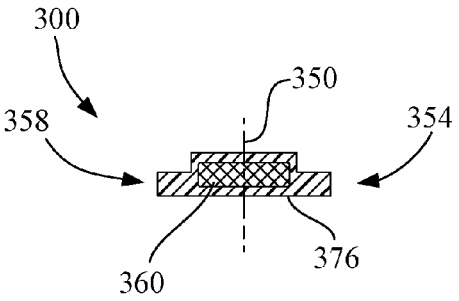
FIG. 31 is a section view of the stir bar taken along line 31-31 of FIG. 29.
Figure 32:
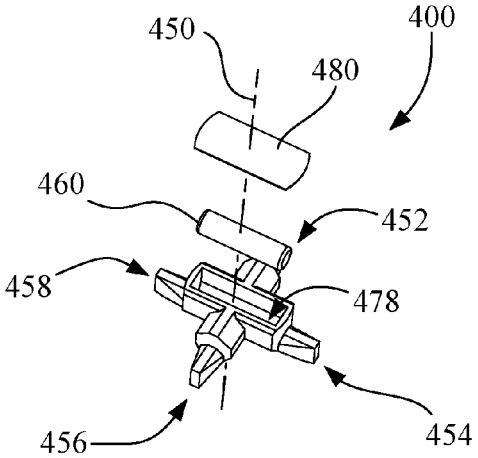
FIG. 32 is an exploded perspective view of another embodiment of a stir bar suitable for use in the microfluidic dispensing device of FIG. 17.
Figure 33:
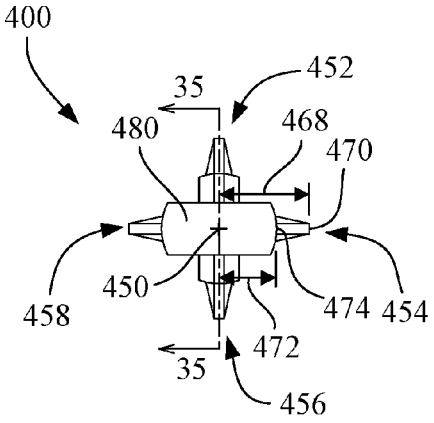
FIG. 33 is a top view of the stir bar of FIG. 32.
Figure 34:
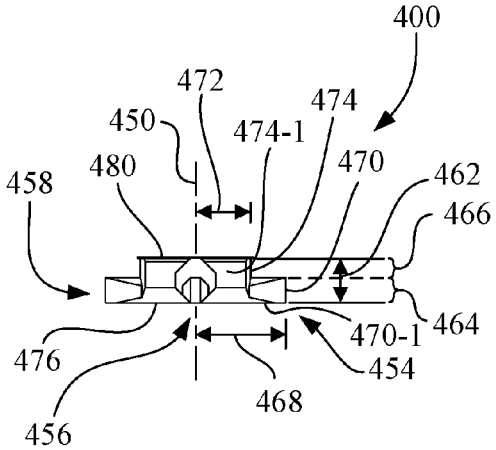
FIG. 34 is a side view of the stir bar of FIG. 32.
Figure 35:
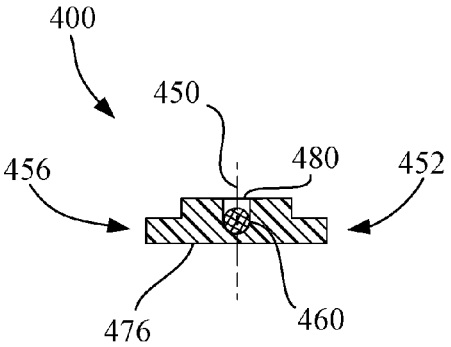
FIG. 35 is a section view of the stir bar taken along line 35-35 of FIG. 33.
Figure 36:
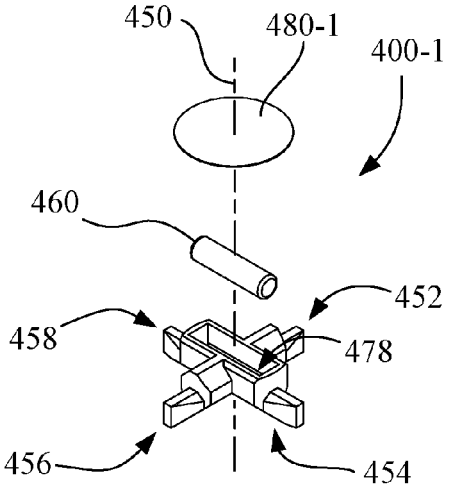
FIG. 36 is an exploded perspective view of another embodiment of a stir bar suitable for use in the microfluidic dispensing device of FIG. 17.
Figure 37:
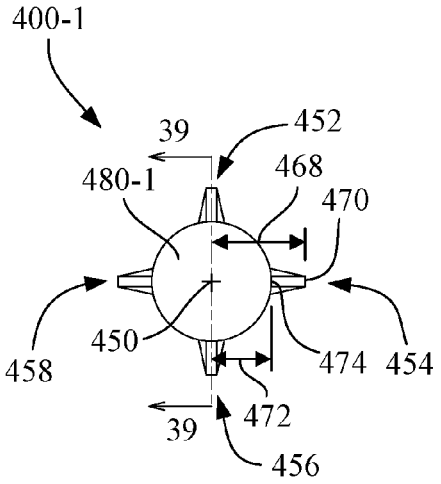
FIG. 37 is a top view of the stir bar of FIG. 36.
Figure 38:
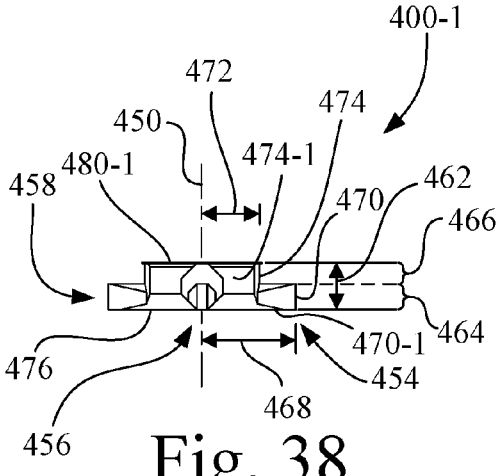
FIG. 38 is a side view of the stir bar of FIG. 36.
Figure 39:
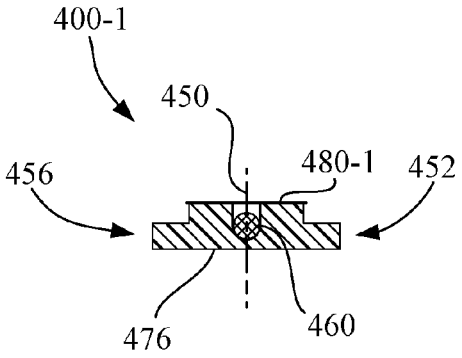
FIG. 39 is a section view of the stir bar taken along line 39-39 of FIG. 37.
Figure 40:
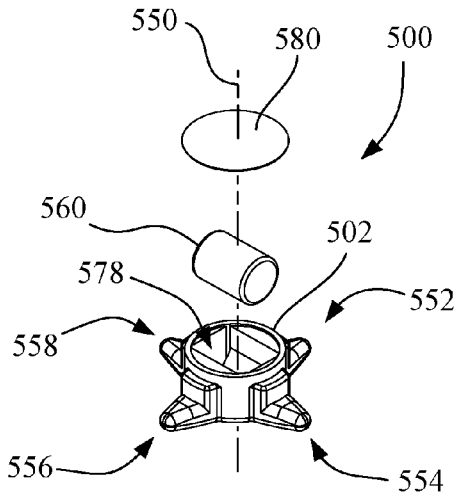
FIG. 40 is an exploded perspective view of another embodiment of a stir bar suitable for use in the microfluidic dispensing device of FIG. 17.
Figure 41:
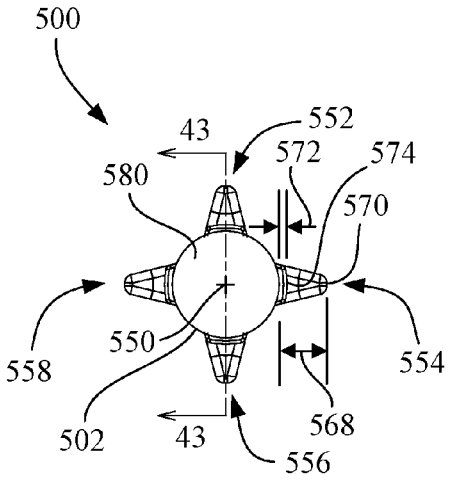
FIG. 41 is a top view of the stir bar of FIG. 40.
Figure 42:
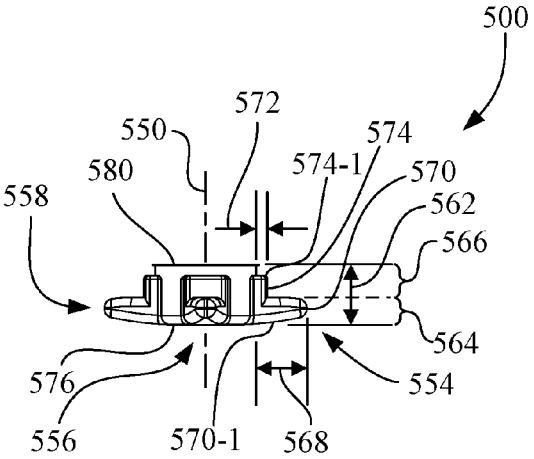
FIG. 42 is a side view of the stir bar of FIG. 40.
Figure 43:
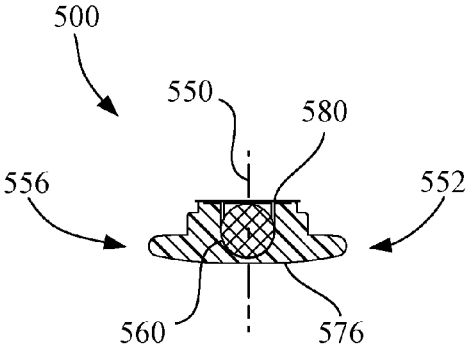
FIG. 43 is a section view of the stir bar taken along line 43-43 of FIG. 41.

In the present embodiment, as shown in FIGS. 24-27, stir bar 224 is configured in a stepped, i.e., two-tiered, cross pattern with chamfered surfaces which may provide the following desired attributes: quiet, short, low axial drag, good rotational speed transfer, and capable of starting to mix with stir bar 224 in particulate sediment. In particular, referring to FIG. 26, each of the plurality of paddles 252, 254, 256, 258 of stir bar 224 has an axial extent 262 having a first tier portion 264 and a second tier portion 266. Referring also to FIG. 25, first tier portion 264 has a first radial extent 268 terminating at a first distal end tip 270. Second tier portion 266 has a second radial extent 272 terminating in a second distal end tip 274. The first radial extent 268 is greater than the second radial extent 272, such that a first rotational velocity of first distal end tip 270 of first tier portion 264 is higher than a second rotational velocity of second distal end tip 274 of second tier portion 266.

Also, in the present embodiment, the first radial extent 268 is not limited by a cage containment structure, as in the previous embodiment, such that first distal end tip 270 advantageously may be positioned closer to the surrounding portions of interior perimetrical wall 240 of chamber 238, particularly in the central continuous ⅓ volume region 228-2 and the distal continuous ⅓ volume region 228-3. By reducing the clearance between first distal end tip 270 and interior perimetrical wall 240 of chamber 238, mixing effectiveness is improved. Stir bar 224 has a stir bar radius (first radial extent 268) from rotational axis 250 to the distal end tip 270 of first tier portion 264 of a respective paddle. A ratio of the stir bar radius and a clearance distance between the distal end tip 270 and its closest encounters with interior perimetrical wall 240 may be 5:2 to 5:0.025. In the present example, such clearance at each of the closest encounters may be in a range of 2.0 millimeters to 0.1 millimeters, and more preferably, is in a range of 1.0 millimeters to 0.1 millimeters.

First tier portion 264 has a first tip portion 270-1 that includes first distal end tip 270. First tip portion 270-1 may be tapered in a direction from the rotational axis 250 toward first distal end tip 270. First tip portion of 270-1 of first tier portion 264 has symmetrical upper and lower surfaces, each having a beveled, i.e., chamfered, leading surface and a beveled trailing surface. The beveled leading surfaces and the beveled trailing surfaces of first tip portion 270-1 are configured to converge at first distal end tip 270.

Also, in the present embodiment, first tier portion 264 of each of the plurality of paddles 252, 254, 256, 258 collectively form a convex surface 276. As shown in FIG. 18, convex surface 276 has a drag-reducing radius positioned to contact base wall 230 of chamber 238. The drag-reducing radius may be, for example, at least three times greater than the first radial extent 268 of first tier portion 264 of each of the plurality of paddles 252, 254, 256, 258.

Referring again to FIG. 26, second tier portion 266 has a second tip portion 274-1 that includes second distal end tip 274. Second distal end tip 274 may have a radial blunt end surface. Second tier portion 266 of each of the plurality of paddles 252, 254, 256, 258 has an upper surface having a beveled, i.e., chamfered, leading surface and a beveled trailing surface.

Referring to FIGS. 19-27, the rotational axis 250 of stir bar 224 may be oriented in an angular range of perpendicular, plus or minus 45 degrees, relative to the fluid ejection direction 120-1. Stated differently, the rotational axis 250 of stir bar 224 may be oriented in an angular range of parallel, plus or minus 45 degrees, relative to the planar extent (e.g., plane 234) of ejection chip 118. Also, rotational axis 250 of stir bar 224 may be oriented in an angular range of perpendicular, plus or minus 45 degrees, relative to the planar extent of base wall 230. In combination, the rotational axis 250 of stir bar 224 may be oriented in both an angular range of perpendicular, plus or minus 45 degrees, relative the fluid ejection direction 120-1 and/or the planar extent of base wall 230, and an angular range of parallel, plus or minus 45 degrees, relative to the planar extent of ejection chip 118.

More preferably, the rotational axis 250 has an orientation that is substantially perpendicular to the fluid ejection direction 120-1, an orientation that is substantially parallel to the plane 234, i.e., planar extent, of ejection chip 118, and an orientation that is substantially perpendicular to the plane 236 of base wall 230. In the present embodiment, the rotational axis 250 of stir bar 224 has an orientation that is substantially perpendicular to the plane 236 of base wall 230 in all orientations around rotational axis 250 and/or is substantially perpendicular to the fluid ejection direction 120-1 in all orientations around rotational axis 250.

The orientations of stir bar 224, described above, may be achieved by guide portion 226, with guide portion 226 also being located within chamber 238 in the variable volume of fluid reservoir 228, and more particularly, within the boundary defined by interior perimetrical wall 240 of chamber 238. Guide portion 226 is configured to confine and position stir bar 224 in a predetermined portion of the interior space of chamber 238 at one of the predefined orientations, described above.

Referring to FIGS. 18-21, for example, guide portion 226 may be configured to position the rotational axis 250 of stir bar 224 in an angular range of parallel, plus or minus 45 degrees, relative to the planar extent of ejection chip 118, and more preferably, guide portion 226 is configured to position the rotational axis 250 of stir bar 224 substantially parallel to the planar extent of ejection chip 118. In the present embodiment, guide portion 226 is configured to position and maintain an orientation of the rotational axis 250 of stir bar 224 to be substantially perpendicular to the plane 236 of base wall 230 in all orientations around rotational axis 250 and to be substantially parallel to the planar extent of ejection chip 118 in all orientations around rotational axis 250.

Referring to FIGS. 19-21 and 23, guide portion 226 includes an annular member 278, and a plurality of mounting arms 280-1, 280-2, 280-3, 280-4 coupled to annular member 278. Annular member 278 has an opening 278-1 that defines an annular confining surface 278-2. Opening 278-1 has a central axis 282. Second tier portion 266 of stir bar 224 is received in opening 278-1 of annular member 278. Annular confining surface 278-2 is configured to contact the radial extent of second tier portion 266 of the plurality of paddles 252, 254, 256, 258 to limit radial movement of stir bar 224 relative to the central axis 282. Referring to FIGS. 18-20 and 23, annular member 278 has an axial restraint surface 278-3 positioned to be axially offset from base wall 230 of chamber 238, for axial engagement with first tier portion 264 of stir bar 224.

Referring to FIGS. 20 and 21, the plurality of mounting arms 280-1, 280-2, 280-3, 280-4 are configured to engage housing 212 to suspend annular member 278 in the interior space of chamber 238, separated from base wall 230 of chamber 238, with axial restraint surface 278-3 positioned to face, and to be axially offset from, base wall 230 of chamber 238. A distal end of each of mounting arms 280-1, 280-2, 280-3, 280-4 includes respective locating features 280-5, 280-6, 280-7, 280-8 that have free ends to engage a perimetrical portion of diaphragm 222.

In the present embodiment, base wall 230 limits axial movement of stir bar 224 relative to the central axis 282 in a first axial direction and axial restraint surface 278-3 of annular member 278 is located to axially engage at least a portion of first tier portion 264 of the plurality of paddles 252, 254, 256, 258 to limit axial movement of stir bar 224 relative to the central axis 282 in a second axial direction opposite to the first axial direction.

As such, in the present embodiment, stir bar 224 is confined in a free-floating manner within the region defined by opening 278-1 and annular confining surface 278-2 of annular member 278, and between axial restraint surface 278-3 of annular member 278 and base wall 230 of chamber 238. The extent to which stir bar 224 is free-floating is determined by the radial tolerances provided between annular confining surface 278-2 and stir bar 224 in the radial direction, and by the axial tolerances between stir bar 224 and the axial limit provided by the combination of base wall 230 and axial restraint surface 278-3 of annular member 278. For example, the tighter the radial and axial tolerances provided by guide portion 226, the less variation of the rotational axis 250 of stir bar 224 from perpendicular relative to base wall 230, and the less side-to-side motion of stir bar 224 within fluid reservoir 228.

In the present embodiment, guide portion 226 is configured as a unitary insert member that is removably attached to housing 212. Referring to FIG. 23, guide portion 226 includes a first retention feature 284 and body 214 of housing 212 includes a second retention feature 214-2. First retention feature 284 is engaged with second retention feature 214-2 to attach guide portion 226 to body 214 of housing 212 in a fixed relationship with housing 212. First retention feature 284/second retention feature 214-2 combination may be, for example, in the form of a tab/slot arrangement, or alternatively, a slot/tab arrangement, respectively.

As best shown in FIG. 23 with respect to FIG. 19, guide portion 226 may further include a flow control portion 286 having a flow separator feature 286-1, a flow rejoining feature 286-2, and a concavely arcuate surface 286-3. Flow control portion 286 provides an axial spacing between axial restraint surface 278-3 and base wall 230 in the region of inlet fluid port 242 and outlet fluid port 244. Concavely arcuate surface 286-3 is coextensive with, and extends between, each of flow separator feature 286-1 and flow rejoining feature 286-2. Flow separator feature 286-1 is positioned adjacent inlet fluid port 242 and flow rejoining feature 286-2 is positioned adjacent outlet fluid port 244. Flow separator feature 286-1 has a beveled wall that cooperates with beveled inlet ramp 242-1 (see FIG. 19) of inlet fluid port 242 of chamber 238 to guide fluid toward channel inlet 246-1 of fluid channel 246. Likewise, flow rejoining feature 286-2 has a beveled wall that cooperates with beveled outlet ramp 244-1 (see FIG. 19) of outlet fluid port 244 to guide fluid away from channel outlet 246-2 of fluid channel 246.

It is contemplated that all, or a portion, of flow control portion 286 may be incorporated into interior perimetrical wall 240 of chamber 238 of body 214 of housing 212.

In the present embodiment, as is best shown in FIG. 23, stir bar 224 is oriented such that the free ends of the plurality of paddles 252, 254, 256, 258 periodically face concavely arcuate surface 286-3 of flow control portion 286 as stir bar 224 is rotated about the rotational axis 250. A ratio of the stir bar radius and a clearance distance between the distal end tip 270 of first tier portion 264 of a respective paddle and flow control portion 286 may be 5:2 to 5:0.025. More particularly, guide portion 226 is configured to confine stir bar 224 in a predetermined portion of the interior space of chamber 238. In the present example, a distance between first distal end tip 270 and concavely arcuate surface 286-3 of flow control portion 286 is in a range of 2.0 millimeters to 0.1 millimeters, and more preferably, is in a range of 1.0 millimeters to 0.1 millimeters.

Also referring to FIG. 18, guide portion 226 is configured to position the rotational axis 250 of stir bar 224 in a portion of fluid reservoir 228 such that first distal end tip 270 of each of the plurality of paddles 252, 254, 256, 258 of stir bar 224 rotationally ingresses and egresses a proximal continuous ⅓ volume portion 228-1 of fluid reservoir 228 that is closer to ejection chip 118. Stated differently, guide portion 226 is configured to position the rotational axis 250 of stir bar 224 in a portion of the interior space such that first distal end tip 270 of each of the plurality of paddles 252, 254, 256, 258 rotationally ingresses and egresses the continuous ⅓ volume portion 228-1 of the interior space of chamber 238 that includes inlet fluid port 242 and outlet fluid port 244.

More particularly, in the present embodiment wherein stir bar 224 has four paddles, guide portion 226 is configured to position the rotational axis 250 of stir bar 224 in a portion of the interior space of chamber 238 such that first distal end tip 270 of each the two pairs of diametrically opposed paddles alternatingly and respectively are positioned in the proximal continuous ⅓ portion 228-1 of the volume of the interior space of chamber 238 that includes inlet fluid port 242 and outlet fluid port 244 and in the distal continuous ⅓ portion 228-3 of the interior space that is furthest from ejection chip 118. More particularly, in the present embodiment wherein stir bar 224 has two sets of diametrically opposed paddles, guide portion 226 is configured to position the rotational axis 250 of stir bar 224 in a portion of the interior space of chamber 238 such that first distal end tip 270 of each of diametrically opposed paddles, e.g., 252, 256 or 254, 258, as shown in FIG. 23, alternatingly and respectively are positioned in the proximal continuous ⅓ volume portion 228-1 and the distal continuous ⅓ volume portion 228-3 as stir bar 224 is rotated.

FIGS. 28-31 show a configuration for a stir bar 300, which may be substituted for stir bar 224 of microfluidic dispensing device 210 discussed above with respect to the embodiment of FIGS. 17-27 for use with guide portion 226.

Stir bar 300 has a rotational axis 350 and a plurality of paddles 352, 354, 356, 358 that radially extend away from the rotational axis 350. Stir bar 300 has a magnet 360 (see FIG. 31), e.g., a permanent magnet, configured for interaction with external magnetic field generator 164 (see FIG. 1) to drive stir bar 300 to rotate around the rotational axis 350. In the present embodiment, stir bar 300 has two pairs of diametrically opposed paddles that are equally spaced at 90 degree increments around rotational axis 350.

In the present embodiment, as shown, stir bar 300 is configured in a stepped, i.e., two-tiered, cross pattern with chamfered surfaces. In particular, each of the plurality of paddles 352, 354, 356, 358 of stir bar 300 has an axial extent 362 having a first tier portion 364 and a second tier portion 366. First tier portion 364 has a first radial extent 368 terminating at a first distal end tip 370. Second tier portion 366 has a second radial extent 372 terminating in a second distal end tip 374. The first radial extent 368 is greater than the second radial extent 372, such that a first rotational velocity of first distal end tip 370 of first tier portion 364 of stir bar 300 is higher than a second rotational velocity of second distal end tip 374 of second tier portion 366 of stir bar 300.

First tier portion 364 has a first tip portion 370-1 that includes first distal end tip 370. First tip portion 370-1 may be tapered in a direction from the rotational axis 350 toward first distal end tip 370. First tip portion 370-1 of first tier portion 364 has symmetrical upper and lower surfaces, each having a beveled, i.e., chamfered, leading surface and a beveled trailing surface. The beveled leading surfaces and the beveled trailing surfaces of first tip portion 370-1 are configured to converge at first distal end tip 370. Also, in the present embodiment, first tier portion 364 of each of the plurality of paddles 352, 354, 356, 358 collectively form a flat surface 376 for engaging base wall 230.

Second tier portion 366 has a second tip portion 374-1 that includes second distal end tip 374. Second distal end tip 374 may have a radially blunt end surface. Second tier portion 366 has two diametrical pairs of upper surfaces, each having a beveled, i.e., chamfered, leading surface and a beveled trailing surface. However, in the present embodiment, the two diametrical pairs have different configurations, in that the area of the upper beveled leading surface and upper beveled trailing surface for diametrical pair of paddles 352, 356 is greater than the area of bevel of the upper beveled leading surface and upper beveled trailing surface for diametrical pair of paddles 354, 358. As such, adjacent angularly spaced pairs of the plurality of paddles 352, 354, 356, 358 alternatingly provide less and more aggressive agitation, respectively, of the fluid in fluid reservoir 228.

FIGS. 32-35 show a configuration for a stir bar 400, which may be substituted for stir bar 224 of microfluidic dispensing device 210 discussed above with respect to the embodiment of FIGS. 17-27 for use with guide portion 226.

Stir bar 400 has a rotational axis 450 and a plurality of paddles 452, 454, 456, 458 that radially extend away from the rotational axis 450. Stir bar 400 has a magnet 460 (see FIGS. 32 and 35, e.g., a permanent magnet, configured for interaction with external magnetic field generator 164 (see FIG. 1) to drive stir bar 400 to rotate around the rotational axis 450. In the present embodiment, stir bar 400 has two pairs of diametrically opposed paddles that are equally spaced at 90 degree increments around rotational axis 450.

In the present embodiment, as shown, stir bar 400 is configured in a stepped, i.e., two-tiered, cross pattern. In particular, each of the plurality of paddles 452, 454, 456, 458 of stir bar 400 has an axial extent 462 having a first tier portion 464 and a second tier portion 466. First tier portion 464 has a first radial extent 468 terminating at a first distal end tip 470. Second tier portion 466 has a second radial extent 472 terminating in a second distal end tip 474 having a wide radial end shape. The first radial extent 468 is greater than the second radial extent 472, such that a first rotational velocity of first distal end tip 470 of first tier portion 464 of stir bar 400 is higher than a second rotational velocity of second distal end tip 474 of second tier portion 466 of stir bar 400.

First tier portion 464 has a first tip portion 470-1 that includes first distal end tip 370. First tip portion 470-1 may be tapered in a direction from the rotational axis 450 toward first distal end tip 470. First tip portion 470-1 of first tier portion 464 has symmetrical upper and lower surfaces, each having a beveled, i.e., chamfered, leading surface and a beveled trailing surface. The beveled leading surfaces and the beveled trailing surfaces of first tip portion 470-1 are configured to converge at first distal end tip 470. Also, in the present embodiment, first tier portion 464 of each of the plurality of paddles 452, 454, 456, 458 collectively form a flat surface 476 for engaging base wall 230.

Second tier portion 466 has a second tip portion 474-1 that includes second distal end tip 474. Second tip portion 474-1 has a radially blunt end surface. Second tier portion 466 has two diametrical pairs of upper surfaces. However, in the present embodiment, the two diametrical pairs have different configurations, in that the diametrical pair of paddles 452, 456 have upper beveled leading surfaces and upper beveled trailing surfaces, and the diametrical pair of paddles 454, 458 do not, i.e., provide a blunt lateral surface substantially parallel to rotational axis 450.

Referring again to FIGS. 32 and 35, stir bar 400 includes a void 478 that radially intersects the rotational axis 450, with void 478 being located in the diametrical pair of paddles 454, 458. Magnet 460 is positioned in void 478 with the north pole of magnet 460 and the south pole of magnet 460 being diametrically opposed with respect to the rotational axis 450. A film seal 480 is attached, e.g., by ultrasonic welding, heat staking, laser welding, etc., to stir bar 400 to cover over void 478. It is preferred that film seal 480 have a seal layer material that is chemically compatible with the material of stir bar 400. Film seal 480 has a shape that conforms to the shape of the upper surface of second tier portion 466 of diametrical pair of paddles 454, 458. The present configuration has an advantage over a stir bar insert that is molded around the magnet, since insert molding may slightly demagnetize the magnet from the insert mold process heat.

FIGS. 36-39 show a configuration for a stir bar 400-1, having substantially the same configuration as stir bar 400 discussed above with respect to FIGS. 32-35, with the sole difference being the shape of the film seal used to seal void 478. Stir bar 400-1 has a film seal 480-1 having a circular shape, and which has a diameter that forms an arcuate web between adjacent pairs of the plurality of paddles 452, 454, 456, 458. The web features serve to separate the bulk mixing flow in the region between stir bar 400-1 and diaphragm 222, and the regions between adjacent pairs of the plurality of paddles 452, 454, 456, 458.

FIGS. 40-43 show a configuration for a stir bar 500, which may be substituted for stir bar 224 of microfluidic dispensing device 210 discussed above with respect to the embodiment of FIGS. 17-27 for use with guide portion 226.

Stir bar 500 has a cylindrical hub 502 having a rotational axis 550, and a plurality of paddles 552, 554, 556, 558 that radially extend away from cylindrical hub 502. Stir bar 500 has a magnet 560 (see FIGS. 40 and 43), e.g., a permanent magnet, configured for interaction with external magnetic field generator 164 (see FIG. 1) to drive stir bar 500 to rotate around the rotational axis 550.

In the present embodiment, as shown, the plurality of paddles 552, 554, 556, 558 of stir bar 500 are configured in a stepped, i.e., two-tiered, cross pattern with chamfered surfaces. In particular, each of the plurality of paddles 552, 554, 556, 558 of stir bar 500 has an axial extent 562 having a first tier portion 564 and a second tier portion 566. First tier portion 564 has a first radial extent 568 terminating at a first distal end tip 570. Second tier portion 566 has a second radial extent 572 terminating in a second distal end tip 574.

First tier portion 564 has a first tip portion 570-1 that includes first distal end tip 570. First tip portion 570-1 may be tapered in a direction from the rotational axis 550 toward first distal end tip 570. First tip portion 570-1 of first tier portion 564 has symmetrical upper and lower surfaces, each having a beveled, i.e., chamfered, leading surface and a beveled trailing surface. The beveled leading surfaces and the beveled trailing surfaces of first tip portion 570-1 are configured to converge at first distal end tip 570. First tier portion 564 of each of the plurality of paddles 552, 554, 556, 558, and cylindrical hub 502, collectively form a convexly curved surface 576 for engaging base wall 230.

The second tier portion 566 has a second tip portion 574-1 that includes second distal end tip 574. Second distal end tip 574 may have a radially blunt end surface. Second tier portion 566 has an upper surface having a chamfered leading surface and a chamfered trailing surface.

Referring again to FIGS. 40 and 43, stir bar 500 includes a void 578 that radially intersects the rotational axis 550, with void 578 being located in cylindrical hub 502. Magnet 560 is positioned in void 578 with the north pole of magnet 560 and the south pole of magnet 560 being diametrically opposed with respect to the rotational axis 550. A film seal 580 has a shape that conforms to the circular shape of the upper surface of cylindrical hub 502. Film seal 580 is attached, e.g., by ultrasonic welding, heat staking, laser welding, etc., to the upper surface of cylindrical hub 502 of stir bar 500 to cover over void 578. It is preferred that film seal 580 have a seal layer material that is chemically compatible with the material of stir bar 500.

Figure 44:
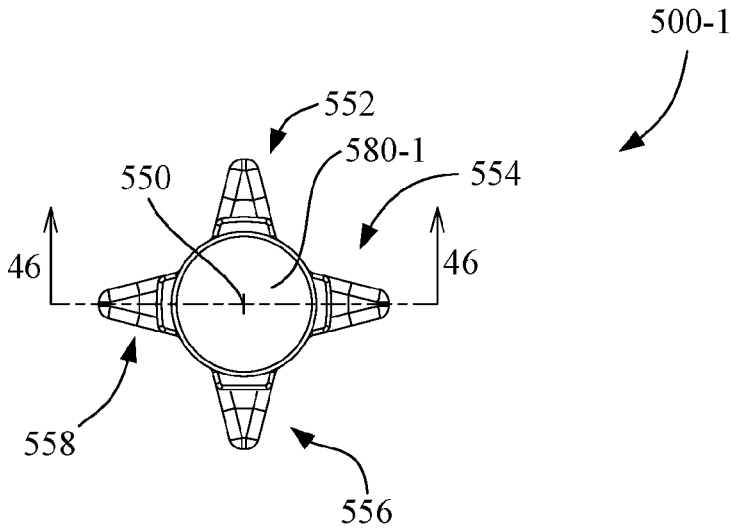
FIG. 44 is a top view of another embodiment of a stir bar suitable for use in the microfluidic dispensing device of FIG. 17.
Figure 45:
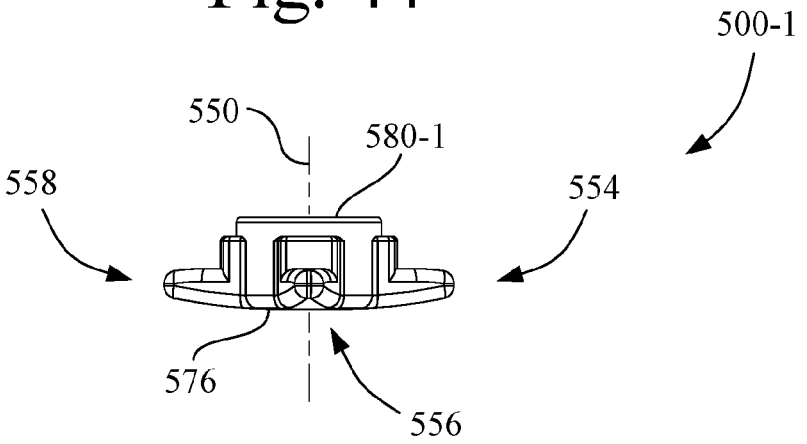
FIG. 45 is a side view of the stir bar of FIG. 45.
Figure 46:
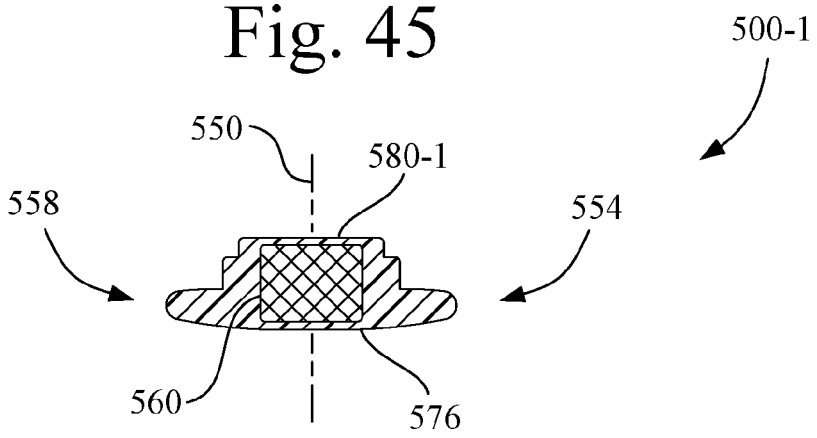
FIG. 46 is a section view of the stir bar taken along line 46-46 of FIG. 44.

FIGS. 44-46 show a configuration for a stir bar 500-1, having substantially the same configuration as stir bar 500 discussed above with respect to FIGS. 40-43, with the sole difference being that film seal 580 used to seal void 578 has been replaced with a permanent cover 580-1. In this embodiment, cover 580-1 is unitary with the stir bar body, which are formed around magnet 560 during the insert molding process.

While the stir bar embodiments of FIGS. 24-46 have been described as being for use with microfluidic dispensing device 210 having guide portion 226, those skilled in the art will recognize that stir bar 132 described above in relation to microfluidic dispensing device 110 having guide portion 134 may be modified to also include a two-tiered stir bar paddle design for use with guide portion 134.

Notwithstanding the use of a stir bar to generate a fluid flow within a fluidic dispensing device to produce a remixing of the fluid contained in the fluidic dispensing device, it has been recognized that in a fluid channel of a fluidic dispensing device there is a potential for stagnation zones to be created, wherein settled particulate is not affected by the fluid flow through the fluid channel and/or a fluid flow through the fluid channel may result in an unintentional depositing of particulate. Such stagnation zones may be created, for example, at locations in the fluid channel where there are abrupt changes in the surface features, such as in a corner defined by orthogonal planar surfaces.

Figure 47:
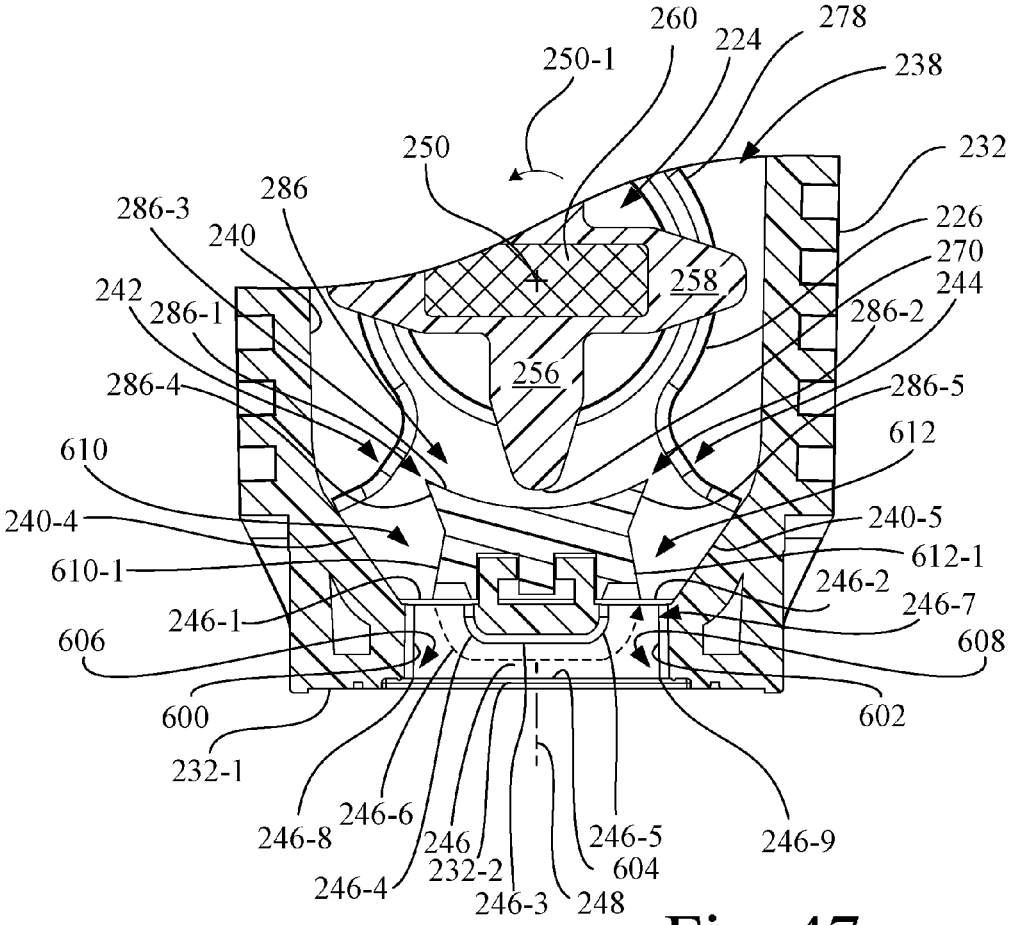
FIG. 47 is a further enlargement of a portion of the depiction of FIG. 23, illustrating the locations of stagnation zones in the fluid channel.

FIG. 47 is a further enlarged portion of the view depicted in FIG. 23. As shown in FIG. 47, fluid channel 246 defines a passage 246-6, represent by a dashed arrowed line, which extends between channel inlet 246-1 and channel outlet 246-2. Stir bar 224, when rotated, generates a fluid flow into channel inlet 246-1, through passage 246-6, and out of channel outlet 246-2.

Passage 246-6 has an outer wall structure 246-7 and an inner wall structure 246-3, 246-4, 246-5 formed by convexly arcuate wall 246-3 and transition radii 246-4, 246-5. Outer wall structure 246-7 is spaced away from inner wall structure 246-3, 246-4, 246-5.

Outer wall structure 246-7 includes an inlet side wall 600, an outlet side wall 602, and a distal wall portion 604. Outlet side wall 602 is spaced away from inlet side wall 600. Distal wall portion 604 is interposed between inlet side wall 600 and outlet side wall 602. Inlet side wall 600 is substantially perpendicular to distal wall portion 604 to define a first corner structure 246-8 that forms a first stagnation zone 606 of passage 246-6. Outlet side wall 602 is substantially perpendicular to distal wall portion 604 to define a second corner structure 246-9 that forms a second stagnation zone 608 of passage 246-6. Referring also to FIG. 18, fluid opening 232-3 extends through exterior wall 232-1 to distal wall portion 604 of fluid channel 246 between first corner structure 246-8, i.e., the first stagnation zone 606 and second corner structure 246-9, i.e., the second stagnation zone 608.

Referring to FIGS. 47-50, flow control portion 286, as a unitary component having flow separator feature 286-1, flow rejoining feature 286-2, and concavely arcuate surface 286-3, further includes an inlet flow director member 610 positioned adjacent to channel inlet 246-1 and an outlet flow director member 612 positioned adjacent to channel outlet 246-2. Inlet flow director member 610 is a portion of inlet fluid port 242 of chamber 238 and outlet flow director member 612 is a portion of outlet fluid port 244 of chamber 238.

More particularly, inlet fluid port 242 of chamber 238 is defined by an interior perimetrical wall portion 240-4 of interior perimetrical wall 240 in opposed combination with an inlet port wall portion 286-4 of flow separator feature 286-1 and inlet flow director member 610. Interior perimetrical wall portion 240-4 of interior perimetrical wall 240 and inlet flow director member 610 are oriented to laterally converge in a direction toward channel inlet 246-1 of fluid channel 246. Conversely, outlet fluid port 244 of chamber 238 is defined by an interior perimetrical wall portion 240-5 of interior perimetrical wall 240 in opposed combination with an outlet port wall portion 286-5 of flow rejoining feature 286-2 of flow control portion 286 and outlet flow director member 612. Interior perimetrical wall portion 240-5 of interior perimetrical wall 240 and outlet flow director member 612 are oriented to laterally diverge in a fluid flow direction away from channel outlet 246-2.

Figure 48:
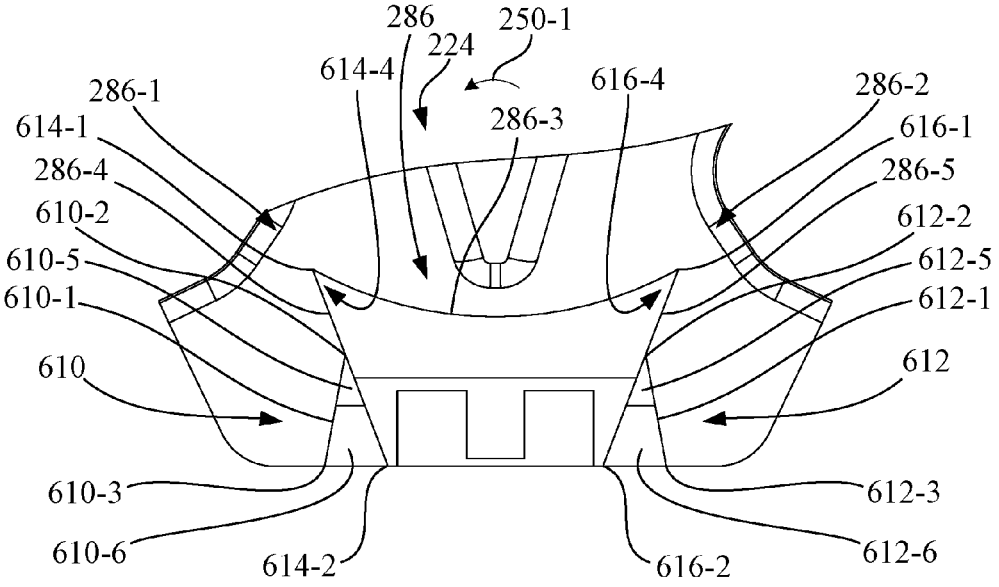
FIG. 48 is a bottom view of an enlargement of a portion of the guide portion of FIG. 21, showing the flow control portion having an inlet flow director member and an outlet flow director member.
Figure 49:
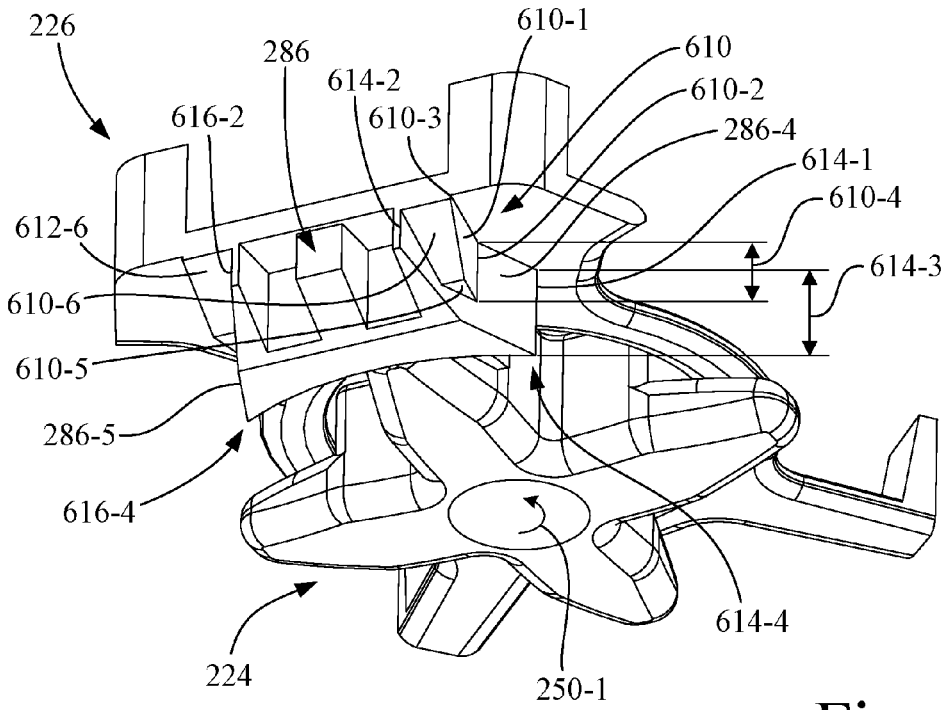
FIG. 49 is an enlarged bottom perspective view of the guide portion of FIG. 21, at an orientation that shows the flow control portion and the several surfaces of the inlet flow director member.
Figure 50:
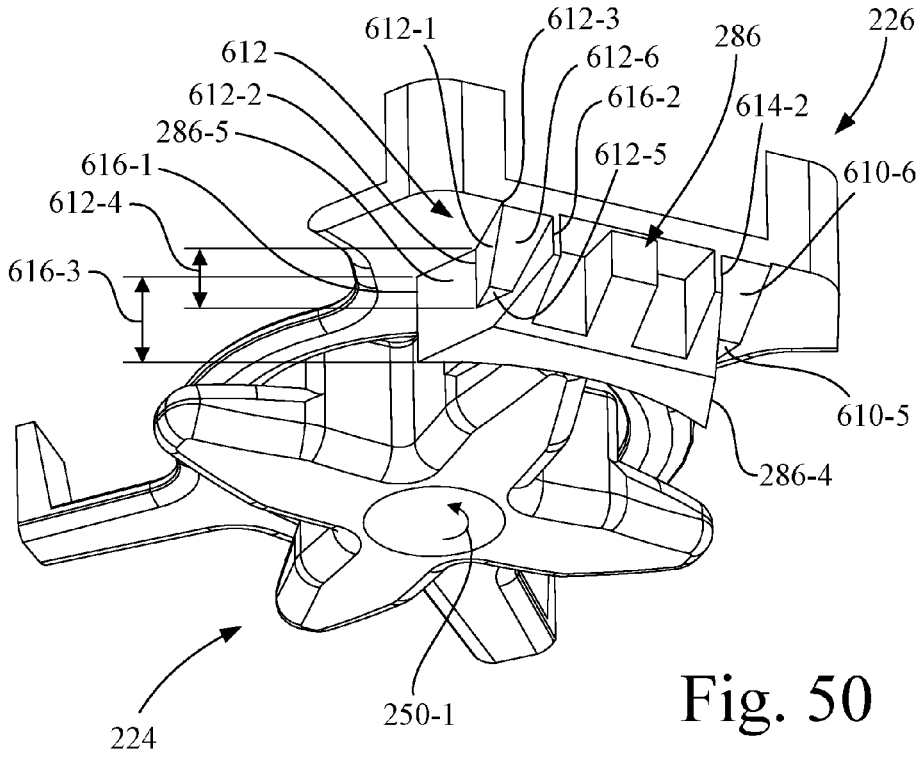
FIG. 50 is an enlarged bottom perspective view of the guide portion of FIG. 21, at an orientation that shows the flow control portion and the several surfaces of the outlet flow director member.

Referring also to FIGS. 48-50, inlet port wall portion 286-4 of flow separator feature 286-1 of flow control portion 286 has a proximal end 614-1, a distal end 614-2, and a first height 614-3 (FIG. 49). The proximal end 614-1 of inlet port wall portion 286-4 is located to intersect concavely arcuate surface 286-3 at an acute angle to form a first apex 614-4 (see FIG. 48). Likewise, outlet port wall portion 286-5 of flow rejoining feature 286-2 of flow control portion 286 has a proximal end 616-1, a distal end 616-2, and a height 616-3 (FIG. 50). The proximal end 616-1 of the outlet port wall portion 286-5 is located to intersect concavely arcuate surface 286-3 at a second acute angle to form a second apex 616-4 (see FIG. 48). The entire curvature of concavely arcuate surface 286-3 extends between first apex 614-4 and second apex 616-4.

Inlet flow director member 610 has a surface structure having an inlet deflection wall portion 610-1 that directs a portion of the fluid flow toward first corner structure 246-8, i.e., the first stagnation zone 606, in passage 246-6. Inlet deflection wall portion 610-1 has a proximal end 610-2, a distal end 610-3, and a height 610-4. The proximal end 610-2 of inlet deflection wall portion 610-1 is located to intersect inlet port wall portion 286-4 of flow separator feature 286-1 at an obtuse angle.

As shown in FIG. 49, height 614-3 of inlet port wall portion 286-4 of flow separator feature 286-1 is greater than the height 610-4 of inlet deflection wall portion 610-1 to further define the surface structure of inlet flow director member 610 to include a first inlet ceiling portion 610-5 having a triangular shape and a second inlet ceiling portion 610-6 having a trapezoidal shape. First inlet ceiling portion 610-5 is positioned to laterally extend from inlet deflection wall portion 610-1 to inlet port wall portion 286-4 of flow control portion 286. Second inlet ceiling portion 610-6 is positioned to laterally extend from inlet deflection wall portion 610-1 of inlet flow director member 610 to inlet port wall portion 286-4 of flow control portion 286. Second inlet ceiling portion 610-6 is positioned to distally extend from first inlet ceiling portion 610-5, and with second inlet ceiling portion 610-6 and first inlet ceiling portion 610-5 positioned to intersect at an obtuse angle.

Referring again to FIGS. 48-50, outlet flow director member 612 has a second surface structure that facilitates generation of one or more eddy currents at second corner structure 246-9, i.e., the second stagnation zone 608, near channel outlet 246-2. In the present embodiment, the second surface structure of outlet flow director member 612 is symmetrical with the first surface structure of inlet flow director member 610 structure with respect to chamber 238, as well as with respect to channel mid-point 248. Outlet flow director member 612 has a second outlet wall portion 612-1 having a proximal end 612-2, a distal end 612-3, and height 612-4. The proximal end 612-2 of second outlet wall portion 612-1 is located to intersect the outlet port wall portion 286-5 of flow rejoining feature 286-2 at a second obtuse angle.

As shown in FIG. 50, height 616-3 of outlet port wall portion 286-5 of flow separator feature 286-1 is greater than the height 612-4 of second outlet deflection wall portion 612-1 to further define the surface structure of outlet flow director member 612 to include a first outlet ceiling portion 612-5 having a triangular shape and a second outlet ceiling portion 612-6 having a trapezoidal shape. The first outlet ceiling portion 612-5 of outlet flow director member 612 is positioned to laterally extend from the second outlet wall portion 612-1 to the outlet port wall portion 286-5 of flow rejoining feature 286-2. The second outlet ceiling portion is positioned to laterally extend from the second outlet wall portion to the outlet port wall portion 286-5. The second outlet ceiling portion is positioned to distally extend from the first outlet ceiling portion and with the second outlet ceiling portion and the first outlet ceiling portion positioned to intersect at an obtuse angle.

FIGS. 51-58 are directed to still another embodiment for reducing the potential for stagnation zones in a fluid channel of a fluidic dispensing device, such as a microfluidic dispensing device 700. The present embodiment utilizes modifications to the wall structure of the chamber so as to reduce the occurrence of abrupt changes in the surface features and/or reducing the lateral extent of any orthogonal walls in the fluid channel region of the fluidic dispensing device.

Microfluidic dispensing device 700 generally includes a housing 702 and a TAB circuit which includes ejection chip 118, such as TAB circuit 114 described above, and which for brevity will not be repeated here. Microfluidic dispensing device 700 is configured to contain a supply of a fluid, such as a fluid containing particulate material. The fluid may be, for example, cosmetics, lubricants, paint, ink, etc.

Figure 51:
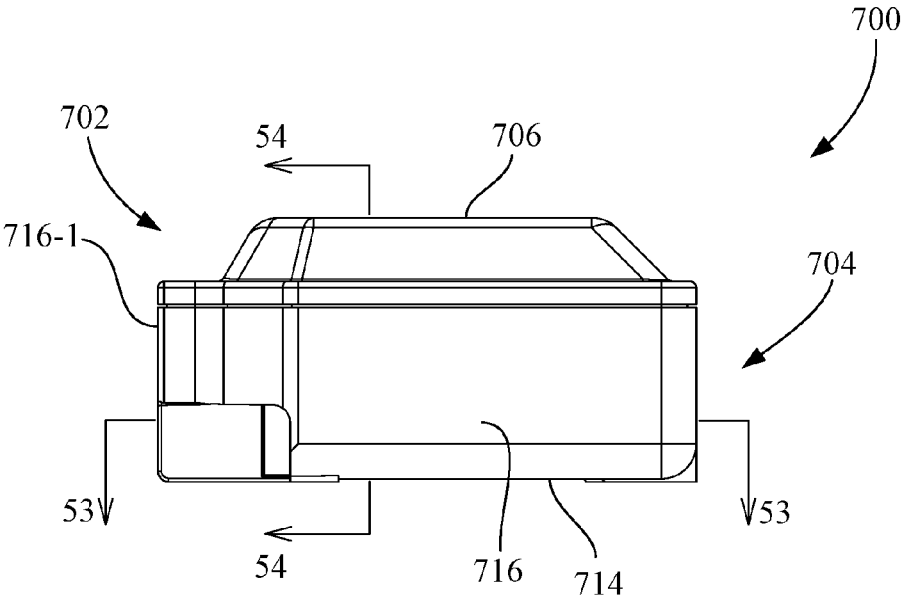
FIG. 51 is a side orthogonal view of another embodiment of a microfluidic dispensing device having features to reduce the occurrence of stagnation zones in the fluid channel.
Figure 52:
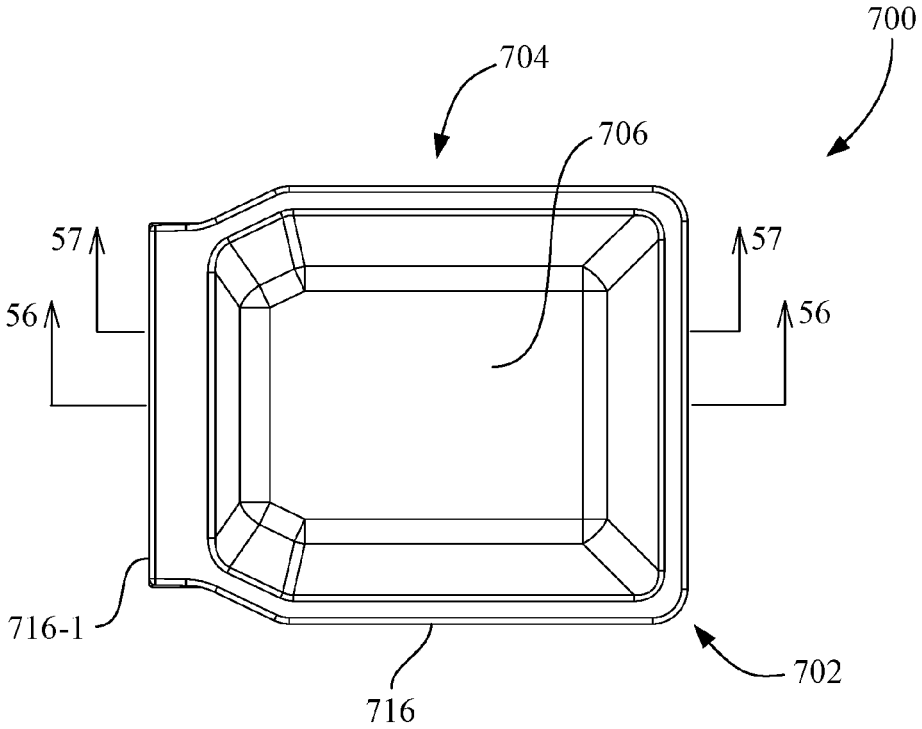
FIG. 52 is a top orthogonal view of the microfluidic dispensing device of FIG. 51.
Figure 56:
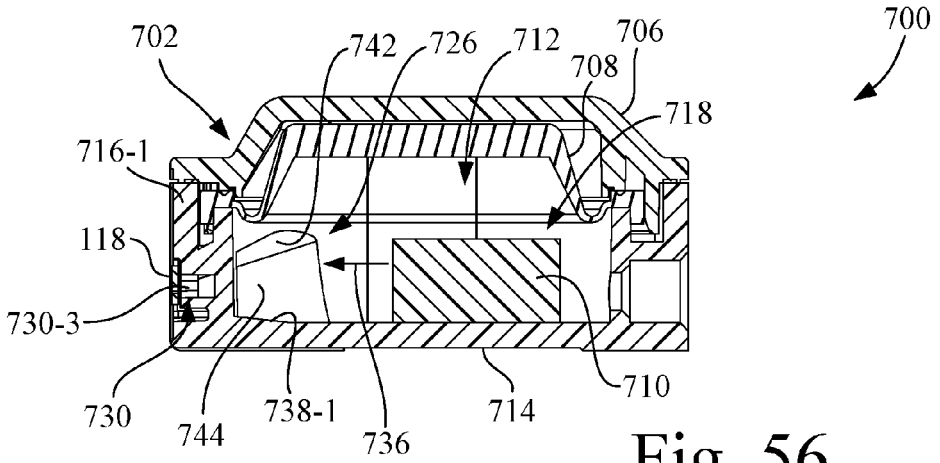
FIG. 56 is a section view of the microfluidic dispensing device taken along line 56-56 of FIG. 52.
Figure 57:
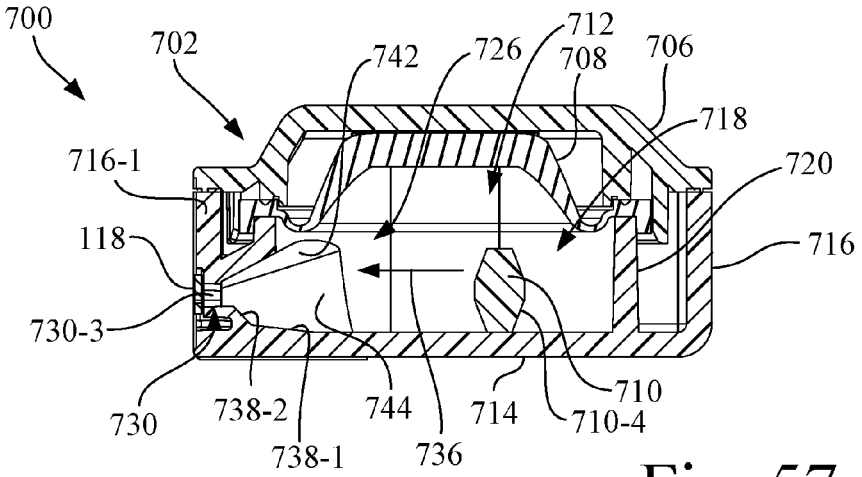
FIG. 57 is a section view of the microfluidic dispensing device taken along line 57-57 of FIG. 52.

Referring to FIGS. 51 and 52, housing 702 includes a body 704 and a lid 706. Referring also to FIGS. 54, 56, and 57, contained within housing 702 is a diaphragm 708 and a stir bar 710 (see also FIG. 53). Each of the housing 702 components (body 704 and lid 706) and stir bar 710 may be made of plastic, using a molding process. Diaphragm 708 is made of rubber, using a molding process.

In general, a fluid (not shown) is contained in a sealed region, i.e., a fluid reservoir 712, between body 704 and diaphragm 708. Stir bar 710 resides in the sealed fluid reservoir 712 between body 704 and diaphragm 708 that contains the fluid. An internal fluid flow may be generated within fluid reservoir 712 by rotating stir bar 710 so as to provide fluid mixing and redistribution of particulate in the fluid within the sealed region of fluid reservoir 712.

Referring now also to FIGS. 53-57, body 704 of housing 702 has a base wall 714 and an exterior perimeter wall 716 contiguous with base wall 714. Exterior perimeter wall 716 is oriented to extend from base wall 714 in a direction that is substantially orthogonal to base wall 714. As best shown in FIGS. 54, 56, and 57, lid 706 is configured to engage exterior perimeter wall 716. Thus, exterior perimeter wall 716 is interposed between base wall 714 and lid 706, with lid 706 being attached to the open free end of exterior perimeter wall 716 by weld, adhesive, or other fastening mechanism, such as a snap fit or threaded union. Attachment of lid 706 to body 704 occurs after installation of stir bar 710 and diaphragm 708.

Figure 58:
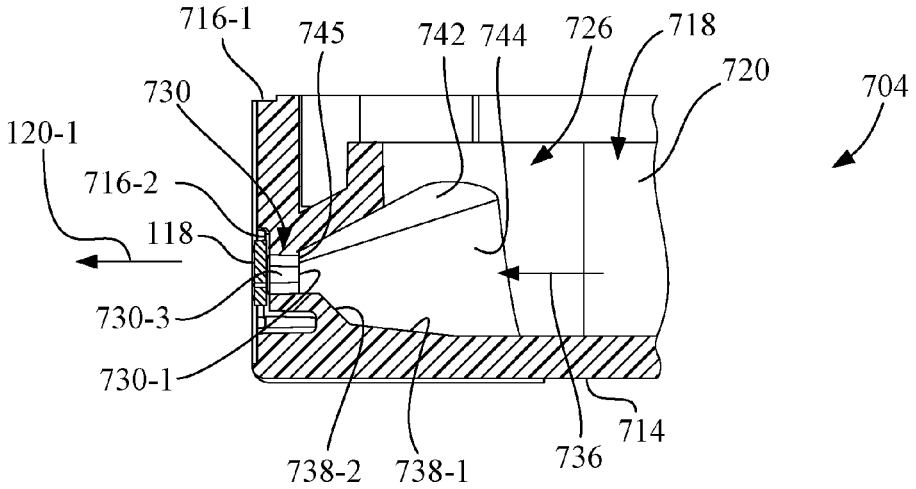
FIG. 58 is an enlargement of a portion of the depiction of FIG. 57.

Referring to FIGS. 56-58, exterior perimeter wall 716 of body 704 includes an exterior wall 716-1, which is a contiguous portion of exterior perimeter wall 716. Exterior wall 716-1 has a chip mounting surface 716-2 that defines a plane, and has a fluid opening 716-3 adjacent to chip mounting surface 716-2 that passes through the thickness of exterior wall 716-1. Ejection chip 118 is mounted to chip mounting surface 716-2 and is in fluid communication with fluid opening 716-3 of exterior wall 716-1. Thus, ejection chip 118 and its associated ejection nozzles are oriented such that the fluid ejection direction 120-1 is substantially orthogonal to the plane of chip mounting surface 716-2. Base wall 714 is oriented along a plane that is substantially orthogonal to the plane of chip mounting surface 716-2 of exterior wall 716-1.

Figure 53:
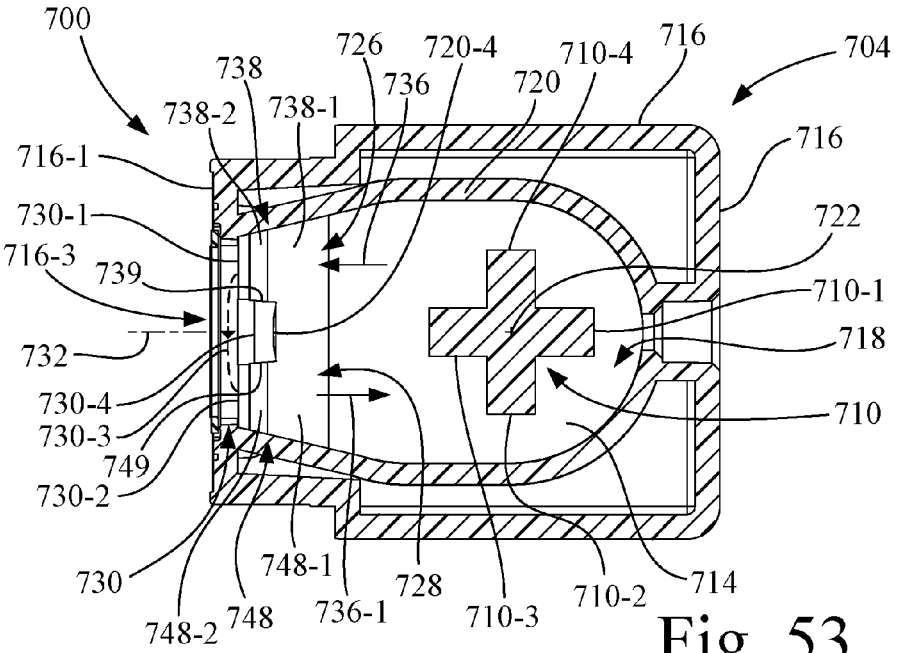
FIG. 53 is a section view of the microfluidic dispensing device taken along line 53-53 of FIG. 51.
Figure 54:
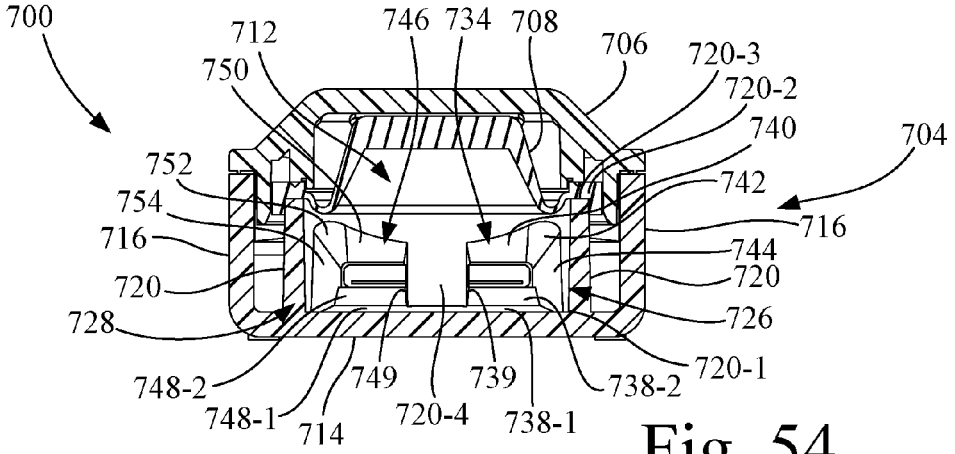
FIG. 54 is a section view of the microfluidic dispensing device taken along line 54-54 of FIG. 51.
Figure 55:
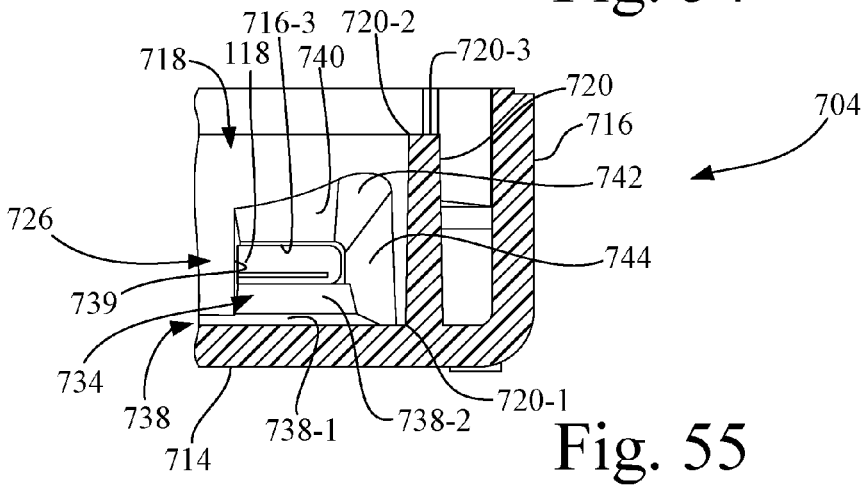
FIG. 55 is an enlargement of a portion of the depiction of FIG. 54.

Referring to FIGS. 53, 55, and 58, body 704 of housing 702 also includes a chamber 718 located within a boundary defined by exterior perimeter wall 716. Chamber 718 forms a portion of fluid reservoir 712, and is configured to define an interior space, and in particular, includes base wall 714 and has an interior perimetrical wall 720 configured to have a rounded perimeter so as to promote fluid flow in chamber 718. Referring also to FIG. 54, interior perimetrical wall 720 of chamber 718 has a height extent bounded by a proximal end 720-1 and a distal end 720-2. Proximal end 720-1 is contiguous with, and may form a transition radius with, base wall 714. Such an edge radius may help in mixing effectiveness by reducing the number of sharp corners. Distal end 720-2 has a perimetrical end surface 720-3 to define a lateral opening of chamber 718. Perimetrical end surface 720-3 may be flat, or may include a plurality of perimetrical ribs, or undulations, to provide an effective sealing surface for engagement with diaphragm 708. Thus, in combination, chamber 718 and diaphragm 708 cooperate to define fluid reservoir 712 having a variable volume. The height extent of interior perimetrical wall 720 of chamber 718 is substantially orthogonal to base wall 714, and is substantially parallel to the corresponding extent of exterior perimeter wall 716.

Referring to FIGS. 53, 56 and 57, stir bar 710 resides in the variable volume of fluid reservoir 712. More particularly, in the orientation shown, stir bar 710 is located in chamber 718, and is located within a boundary defined by the interior perimetrical wall 720 of chamber 718. Stir bar 710 has a rotational axis 722 and a plurality of paddles 710-1, 710-2, 710-3, 710-4 that radially extend away from rotational axis 722. The actual number of paddles of stir bar 710 may be two or more, and preferably three or four, but more preferably four, with each adjacent pair of paddles having the same angular spacing around the rotational axis 722.

Stir bar 710 has a magnet (not shown), e.g., a permanent magnet, configured for interaction with an external magnetic field generator 164 (see FIG. 1) to drive stir bar 710 to rotate around the rotational axis 722, using the drive principles described above. In the present embodiment, stir bar 710 is free-floating with chamber 718, and will be attracted into contact with base wall 714 by the application of the electromagnetic filed generated by external magnetic field generator 164. Stir bar 710 primarily causes rotation flow of the fluid about a central region associated with the rotational axis 722 of stir bar 710, with some axial flow with a central return path as in a partial toroidal flow pattern.

As best shown in FIGS. 53-58, chamber 718 has an inlet fluid port 726 and an outlet fluid port 728, each of which is formed in a portion of interior perimetrical wall 720, with inlet fluid port 726 being separated a distance from outlet fluid port 728 along a portion of interior perimetrical wall 720. In particular, interior perimetrical wall 720 includes a divider wall 720-4 (see FIGS. 53 and 54) located between inlet fluid port 726 and outlet fluid port 728 of the chamber 718. In the present embodiment, the structure of inlet fluid port 726 and outlet fluid port 728 of chamber 718 is symmetrical with respect to chamber 718, and with respect to channel mid-point 732.

The terms "inlet" and "outlet" are terms of convenience that are used in distinguishing between the multiple ports of the present embodiment, and are correlated with a particular rotational direction of stir bar 710. However, it is to be understood that it is the rotational direction of stir bar 710 that dictates whether a particular port functions as an inlet port or an outlet port, and it is within the scope of this invention to reverse the rotational direction of stir bar 710, and thus reverse the roles of the respective ports within chamber 718.

As best shown in FIGS. 53 and 56-58, body 704 of housing 702 includes a fluid channel 730 interposed between a portion (e.g., divider wall 720-4) of interior perimetrical wall 720 of chamber 718 and exterior wall 716-1 of exterior perimeter wall 716 that carries ejection chip 118. Fluid channel 730 has a channel inlet 730-1 and a channel outlet 730-2. Fluid channel 730 dimensions, e.g., height, width, and shape, are selected to facilitate a desired combination of fluid flow and fluid velocity for facilitating intra-channel stirring. Fluid channel 730 is in fluid communication with each of inlet fluid port 726 of chamber 718, outlet fluid port 728 of chamber 718, and fluid opening 716-3 of exterior wall 716-1 that mounts ejection chip 118.

Fluid channel 730 defines a passage 730-3, represented by a dashed arrowed line in FIG. 53, which extends between channel inlet 730-1 and channel outlet 730-2. Fluid channel 730 has an interior wall 730-4 that is positioned between channel inlet 730-1 and channel outlet 730-2, with fluid channel 730 being symmetrical about a channel mid-point 732, and with interior wall 730-4 positioned to face fluid opening 716-3 of exterior wall 716-1 and ejection chip 118. Likewise, the structure of channel inlet 730-1 and channel outlet 730-2 of fluid channel 730 is symmetrical with respect to the channel mid-point 732. Passage 730-3 is in fluid communication with fluid opening 716-3 in the exterior wall 716-1.

Referring also to FIGS. 54 and 55, channel inlet 730-1 of fluid channel 730 is in fluid communication with inlet fluid port 726 of chamber 718 via an inlet transition passage 734. Inlet transition passage 734 is oriented to extend from inlet fluid port 726 of the chamber 718 and into the channel inlet 730-1 of fluid channel 730. Inlet transition passage 734 has a plurality of surfaces 738, 739, 740, 742, 744 that converge in a direction 736 (see FIGS. 53, 54, and 57) from the chamber 718 toward fluid opening 716-3 in the exterior wall 716-1, such that the cross-sectional area of inlet transition passage 734 diminishes in a direction toward fluid channel 730.

Referring to FIGS. 53-58, the plurality of surfaces 738, 739, 740, 742, 744 of the inlet transition passage 734 includes a ramp floor 738, an inner wall 739, a tapered ceiling 740, an angled ceiling portion 742, and a beveled side wall 744. The ramp floor 738 is located between inner wall 739 and beveled side wall 744, and is located to extend from base wall 714 at inlet fluid port 726 of the chamber 718 to the channel inlet 730-1 of fluid channel 730. Each of the tapered ceiling 740 and the beveled side wall 744 is located to extend from the interior perimetrical wall at inlet fluid port 726 of the chamber 718 and into fluid channel 730 to an interior surface 745 of the exterior wall 716-1. The angled ceiling portion 742 transitions from the tapered ceiling 740 to the beveled side wall 744.

Referring also to FIG. 53, in the present embodiment, ramp floor 738 has a first transition ramp portion 738-1 and a second transition ramp portion 738-2. As best shown in FIG. 58, the second transition ramp portion 738-2 is located closer to channel inlet 730-1 of fluid channel 730 than the first transition ramp portion 738-1. The first transition ramp portion 738-1 has a first slope relative to base wall 714 and the second transition ramp portion 738-2 has a second slope relative to base wall 714. The second slope of the second transition ramp portion 738-2 is steeper than the first slope of the first transition ramp portion 738-1.

Referring to FIGS. 53 and 54, channel outlet 730-2 of fluid channel 730 is in fluid communication with outlet fluid port 728 of the chamber 718 via an outlet transition passage 746. Outlet transition passage 746 is oriented to extend from outlet fluid port 728 of the chamber 718 and into the channel outlet 730-2 of fluid channel 730. Outlet transition passage 746 has a plurality of surfaces 748, 749, 750, 752, 754 that diverge in a direction 736-1 away from fluid opening 716-3 in the exterior wall 716-1 and toward chamber 718. Stated differently, the plurality of surfaces 748, 749, 750, 752, 754 of outlet transition passage 746 converge in a direction toward fluid opening 716-3 in the exterior wall 716-1 and away from chamber 718, such that the cross-sectional area of outlet transition passage 746 diminishes in a direction toward fluid channel 730.

In the present embodiment, outlet transition passage 746 is constructed identical to the inlet transition passage 734. At chamber 718, outlet transition passage 746 is separated from inlet transition passage 734 by divider wall 720-4. Also, in the present embodiment, inlet transition passage 734 and the outlet transition passage 746 are symmetrical with respect to the chamber 718, and are symmetrical with respect to channel mid-point 732. The terms "inlet" transition passage and "outlet" transition passage are terms of convenience that are used in distinguishing between the two transition passages of the present embodiment, and are correlated with a particular rotational direction of stir bar 710 as to performing one of an inlet or an outlet function. However, it is to be understood that it is the rotational direction of stir bar 710 that dictates whether a particular transition passage functions as an inlet transition passage or an outlet transition passage, and it is within the scope of this invention to reverse the rotational direction of stir bar 710, and thus reverse the roles of the respective transition passages.

The plurality of surfaces 748, 749, 750, 752, 754 of outlet transition passage 746 includes a ramp floor 748, an inner wall 749, a tapered ceiling 750, an angled ceiling portion 752, and a beveled side wall 754. The ramp floor 748 is located between inner wall 749 and beveled side wall 754, and is located to extend from the base wall 714 at outlet fluid port 728 of the chamber 718 to the channel outlet 730-2 of fluid channel 730. Each of the tapered ceiling 750 and the beveled side wall 754 is located to extend from the interior perimetrical wall at outlet fluid port 728 of the chamber 718 and into fluid channel 730 to interior surface 745 of exterior wall 716-1. Angled ceiling portion 752 transitions from tapered ceiling 750 to beveled side wall 754.

In the present embodiment, ramp floor 748 has a first transition ramp portion 748-1 and a second transition ramp portion 748-2. The second transition ramp portion 748-2 is located closer to channel outlet 730-2 of fluid channel 730 than the first transition ramp portion 748-1. The first transition ramp portion 748-1 has a first slope relative to base wall 714 and the second transition ramp portion 738-2 has a second slope relative to the base wall 714. The second slope of the second transition ramp portion 748-2 is steeper than the first slope of the first transition ramp portion 748-1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:

a housing having an exterior wall and a chamber, the exterior wall having a chip mounting surface and an opening, the chamber having an inlet port and an outlet port, the inlet port being separated a distance from the outlet port;

an ejection chip mounted to the chip mounting surface, the ejection chip being in fluid communication with the opening;

a fluid channel in the housing, the fluid channel having a channel inlet, a channel outlet, and a passage between the channel inlet and the channel outlet, the channel inlet being in fluid communication with the inlet port of the chamber, the channel outlet being in fluid communication with the outlet port of the chamber, the passage being in fluid communication with the opening in the exterior wall, the fluid channel having a first corner structure in the passage;

a stir bar located in the chamber to generate a fluid flow through the fluid channel when rotated; and a first flow director member positioned adjacent the channel inlet, the flow director member having a first surface structure that directs a portion of the fluid flow toward the first corner structure in the passage.

2. The fluidic dispensing device of claim 1, wherein the fluid channel has a second corner structure in the passage, and further comprising a second flow director member positioned adjacent the channel outlet.

3. The fluidic dispensing device of claim 1, further comprising a second flow director member positioned adjacent the channel outlet, the second flow director member having a second surface structure, wherein the first surface structure of the first flow director member structure is symmetrical with the second surface structure of the second flow director member.

4. The fluidic dispensing device of claim 1, further comprising a second flow director member, wherein the first flow director member is a portion of the inlet port of the chamber and the second flow director member is a portion of the outlet port of the chamber.

5. The fluidic dispensing device of claim 1, wherein the fluid channel has a second corner structure in the passage, and the passage has a U-shape, the passage having an outer wall structure and an inner wall structure, the outer wall structure being spaced away from the inner wall structure, the outer wall structure including the first corner structure and the second corner structure.

6. The fluidic dispensing device of claim 5, wherein the outer wall structure includes an inlet side wall, an outlet side wall spaced away from the inlet side wall, and a distal wall portion interposed between the inlet side wall and the outlet side wall, the inlet side wall being substantially perpendicular to the distal wall portion to define the first corner structure of the passage, and the outlet side wall being substantially perpendicular to the distal wall portion to define the second corner structure of the passage.

7. The fluidic dispensing device of claim 6, wherein the opening extends through the exterior wall to the distal wall portion of the fluid channel between the first corner structure and the second corner structure.

8. The fluidic dispensing device of claim 1, comprising a flow control portion positioned in the chamber between the channel inlet and the channel outlet of the fluid channel, the flow control portion having a flow divider positioned in the chamber between the inlet port and the outlet port, and wherein the first flow director member is part of the flow control portion.

9. The fluidic dispensing device of claim 8, wherein the flow divider has a flow separator feature and a flow rejoining feature, the flow separator feature being positioned adjacent the inlet port of the chamber and the flow rejoining feature being positioned adjacent the outlet port of the chamber.

10. The fluidic dispensing device of claim 1, wherein the chamber has an interior perimetrical wall, and the inlet port of the chamber being defined by a first wall portion of the interior perimetrical wall in opposed combination with the first flow director member, the first wall portion of the interior perimetrical wall and the first flow director member oriented to converge in a direction toward the channel inlet.

11. The fluidic dispensing device of claim 10, wherein the outlet port of the chamber is defined by a second wall portion of the interior perimetrical wall in opposed combination with the second flow director member, the second wall portion of the interior perimetrical wall and the second flow director member oriented to diverge in a fluid flow direction away from the channel outlet.

12. A fluidic dispensing device, comprising:

a housing having an exterior wall and a chamber, the exterior wall having a chip mounting surface defining a first plane and having an opening, the chamber configured to define an interior space, the chamber having an inlet port and an outlet port, the inlet port being separated a distance from the outlet port;

an ejection chip mounted to the chip mounting surface of the exterior wall, the ejection chip being in fluid communication with the opening;

a fluid channel formed in the housing, the fluid channel having a channel inlet, a channel outlet, and a passage between the channel inlet and the channel outlet, the opening extending between the passage and the chip mounting surface of the exterior wall, the channel inlet being in fluid communication with the inlet port of the chamber and the channel outlet being in fluid communication with the outlet port of the chamber, the passage having an outer wall structure and an inner wall structure, the outer wall structure being spaced away from the inner wall structure, the outer wall structure including a first corner structure and a second corner structure;

a stir bar which when rotated generates a fluid flow into the channel inlet, through the passage, and out of the channel outlet;

a first flow director member positioned adjacent the channel inlet, the first flow director member having a first surface structure that directs a portion of the fluid flow toward the first corner structure in the passage; and a second flow director member positioned adjacent the channel outlet, the second flow director member having a second surface structure.

13. The fluidic dispensing device of claim 12, comprising a flow control portion formed as a unitary component that is positioned in the chamber between the channel inlet and the channel outlet of the fluid channel, the flow control portion having a flow separator feature, a flow rejoining feature, the first flow director member and the second flow director member, the flow separator feature being positioned adjacent the inlet port of the chamber and having a beveled wall that cooperates with a beveled inlet ramp of the inlet port to guide fluid toward the channel inlet of the fluid channel, the flow rejoining feature being positioned adjacent the outlet port of the chamber and having a beveled wall that cooperates with a beveled outlet ramp of the outlet port to guide fluid away from the channel outlet of the fluid channel.

14. The fluidic dispensing device of claim 12, comprising a flow control portion positioned in the chamber between the channel inlet and the channel outlet of the fluid channel, the flow control portion having a flow separator feature, a flow rejoining feature, the first flow director member and the second flow director member, wherein:

the flow separator feature and the flow rejoining feature combine to define a concavely arcuate wall, the flow separator feature further having a first inlet port wall portion having a proximal end, a distal end, and a first height, the proximal end of the inlet port wall portion located to intersect the concavely arcuate wall at a first acute angle to form a first apex, the flow rejoining feature having a first outlet port wall portion having a proximal end, a distal end, and a second height, the proximal end of the first outlet port wall portion located to intersect the concavely arcuate wall at a second acute angle to form a second apex, the entire curvature of the concavely arcuate wall extending between the first apex and the second apex;

the first flow director member having an inlet deflection wall portion having a proximal end, a distal end, and a third height, the proximal end of the inlet deflection wall portion located to intersect the first inlet port wall portion at a first obtuse angle, the second flow director member having a second outlet wall portion having a proximal end, a distal end, and a fourth height, the proximal end of the second outlet wall portion located to intersect the first outlet port wall portion at a second obtuse angle, the first height being greater than the third height to define a first inlet ceiling portion having a triangular shape and a second inlet ceiling portion having a trapezoidal shape, the first inlet ceiling portion positioned to laterally extend from the inlet deflection wall portion to the first inlet port wall portion, the second inlet ceiling portion positioned to laterally extend from the inlet deflection wall portion to the first inlet port wall portion, the second inlet ceiling portion positioned to distally extend from the first inlet ceiling portion and with the second inlet ceiling portion and the first inlet ceiling portion positioned to intersect at an obtuse angle;

the second height being greater than the fourth height to define a first outlet ceiling portion having a triangular shape and a second outlet ceiling portion having a trapezoidal shape, the first outlet ceiling portion positioned to laterally extend from the second outlet wall portion to the first outlet port wall portion, the second outlet ceiling portion positioned to laterally extend from the second outlet wall portion to the first outlet port wall portion, the second outlet ceiling portion positioned to distally extend from the first outlet ceiling portion and with the second outlet ceiling portion and the first outlet ceiling portion positioned to intersect at an obtuse angle.

15. A fluidic dispensing device, comprising:

a housing having an exterior wall and a chamber, the exterior wall having a chip mounting surface for mounting an ejection chip, the chamber configured to define an interior space, the chamber having a base wall, an interior perimetrical wall, an inlet port and an outlet port, the inlet port being separated a distance from the outlet port;

a stir bar located in the chamber;

a fluid channel in the housing, the fluid channel having a channel inlet, a channel outlet, and a passage between the channel inlet and the channel outlet, the channel inlet being in fluid communication with the inlet port of the chamber, the channel outlet being in fluid communication with the outlet port of the chamber, the passage being in fluid communication with the opening in the exterior wall;

an inlet transition passage oriented to extend from the inlet port of the chamber and into the channel inlet of the fluid channel, the inlet transition passage having a plurality of surfaces that converge in a direction from the chamber toward the opening in the exterior wall;

an outlet transition passage oriented to extend from the outlet port of the chamber and into the channel outlet of the fluid channel, the outlet transition passage having a plurality of surfaces that diverge in a direction away from the opening in the exterior wall and toward the chamber.

16. The fluidic dispensing device of claim 15, wherein the plurality of surfaces of the inlet transition passage includes a ramp floor, a tapered ceiling, and a beveled side wall, the ramp floor located to extend from the base wall at the inlet port of the chamber to the channel inlet of the fluid channel, and each of the tapered ceiling and the beveled side wall located to extend from the interior perimetrical wall at the inlet port of the chamber and into the fluid channel to an interior surface of the exterior wall.

17. The fluidic dispensing device of claim 16, wherein the ramp floor has a first transition ramp portion and a second transition ramp portion, the second transition ramp portion being located closer to the channel inlet of the fluid channel than the first transition ramp portion, the first transition ramp portion having a first slope relative to the base wall and the second transition ramp portion having a second slope relative to the base wall, the second slope of the second transition ramp portion being steeper than the first slope of the first transition ramp portion.

18. The fluidic dispensing device of claim 16, wherein the plurality of surfaces further includes an angled ceiling portion that transitions from the tapered ceiling to the beveled side wall.

19. The fluidic dispensing device of claim 15, wherein the outlet transition passage is constructed identical to the inlet transition passage, the inlet transition passage and the outlet transition passage being symmetrical with respect to the chamber.

20. The fluidic dispensing device of claim 15, wherein the interior perimetrical wall includes a divider wall located between the inlet port and the outlet port of the chamber.

* * * * *